US010167576B2

(12) United States Patent
Chao et al.

(10) Patent No.: US 10,167,576 B2
(45) Date of Patent: Jan. 1, 2019

(54) METHOD OF PRODUCING FINE FIBER, AND FINE FIBER, NON-WOVEN FABRIC, AND FINE FIBROUS CELLULOSE

(71) Applicant: Oji Holdings Corporation, Tokyo (JP)

(72) Inventors: Yaping Chao, Bangkok (TH); Yasutomo Noishiki, Tokyo (JP)

(73) Assignee: OJI Holdings Corporation, Tokyo (JP)

( * ) Notice: Subject to any disclaimer, the term of this patent is extended or adjusted under 35 U.S.C. 154(b) by 803 days.

(21) Appl. No.: 14/378,247

(22) PCT Filed: May 16, 2013

(86) PCT No.: PCT/JP2013/063664
§ 371 (c)(1),
(2) Date: Aug. 12, 2014

(87) PCT Pub. No.: WO2013/176033
PCT Pub. Date: Nov. 28, 2013

(65) Prior Publication Data

US 2015/0079866 A1 Mar. 19, 2015

(30) Foreign Application Priority Data

May 21, 2012 (JP) ..... 2012-115411
Aug. 10, 2012 (JP) ..... 2012-178344

(51) Int. Cl.

| | |
|---|---|
| ***D01F 2/00*** | (2006.01) |
| ***D21C 5/00*** | (2006.01) |
| ***D04H 1/425*** | (2012.01) |
| ***D04H 1/4382*** | (2012.01) |
| ***D21H 11/20*** | (2006.01) |
| ***D01C 1/00*** | (2006.01) |
| ***D06M 16/00*** | (2006.01) |
| ***D21H 11/18*** | (2006.01) |
| *D06M 101/06* | (2006.01) |

(52) U.S. Cl.
CPC ..... *D01F 2/00* (2013.01); *D01C 1/00* (2013.01); *D04H 1/425* (2013.01); *D04H 1/4382* (2013.01); *D06M 16/003* (2013.01); *D21C 5/005* (2013.01); *D21H 11/18* (2013.01); *D21H 11/20* (2013.01); *D06M 2101/06* (2013.01); *D10B 2201/01* (2013.01); *Y10T 428/298* (2015.01); *Y10T 442/60* (2015.04)

(58) Field of Classification Search
CPC ..... D01F 2/00; D21C 5/0005; D06M 16/003; D06M 2101/06; D01C 1/00; D21H 11/20
USPC ..... 435/18; 162/91
See application file for complete search history.

(56) References Cited

U.S. PATENT DOCUMENTS 4,307,121 A * 12/1981 Thompson ..... D21C 3/18 127/37
2007/0151683 A1* 7/2007 Pere ..... D21B 1/021 162/72
2012/0118520 A1 5/2012 Noishiki et al.

FOREIGN PATENT DOCUMENTS

| | | |
|---|---|---|
| JP | A-06-010288 | 1/1994 |
| JP | A-06-506732 | 7/1994 |
| JP | A-07-331588 | 12/1995 |
| JP | A-08-500727 | 1/1996 |
| JP | A-2006-008857 | 1/2006 |
| JP | A-2008-075214 | 4/2008 |
| JP | A-2008-150719 | 7/2008 |
| JP | A-2008-169497 | 7/2008 |
| JP | A-2008-538176 | 10/2008 |
| JP | A-2009-526140 | 7/2009 |
| JP | A-2010-268748 | 12/2010 |
| JP | A-2011-184816 | 9/2011 |
| JP | A-2011-184825 | 9/2011 |
| JP | A-2012-036529 | 2/2012 |
| JP | A-2012-046846 | 3/2012 |
| JP | A-2012-046848 | 3/2012 |
| WO | WO 92/18688 A1 | 10/1992 |
| WO | WO 93/24621 | 12/1993 |
| WO | WO 03/070940 A1 | 8/2003 |
| WO | WO 2005/056915 A1 | 6/2005 |
| WO | WO 2006/101584 A2 | 9/2006 |
| WO | WO 2007/091942 A1 | 8/2007 |
| WO | WO 2011/004300 A1 | 1/2011 |
| WO | WO 2011/013567 A1 | 2/2011 |
| WO | WO 2012/043103 A1 | 4/2012 |

OTHER PUBLICATIONS

Henriksson et al. An Environmentally Friendly Method for Enzyme-Assisted Preparation of Microfibrillated Cellulose (MFC) Nanofibers; European Polymer Journal, vol. 43, pp. 3434-3441. (Year: 2007).*
Liu et al. Visualization of Enzymatic Hydrolysis of Cellulose Using AFM Phase Imaging; Enzyme an Microbial Technology, vol. 45, pp. 274-281. (Year: 2009).*
Search Report in European Patent Application No. 13793753.8, dated Dec. 9, 2015.
Improvement of Enzymatic Saccharification of Unbleached Cedar Pulp with Amphipathic Lignin Derivatives, BioResources8(2), pp. 2195-2208, 2013[0nline], Retrieved on Dec. 7, 2016, URL: https://www.ncsu.edu/bioresources/BioRes_08/BioRes08_2_2195_Winami_Improvement_Enzymatic_Saccharification_Unbleached 3669.pdf.
Office Action in Japanese Patent Application No. 2014-516773, dated Apr. 5, 2016.

(Continued)

*Primary Examiner* — Scott Long
*Assistant Examiner* — Paul C Martin
(74) *Attorney, Agent, or Firm* — Knobbe, Martens, Olson & Bear, LLP

(57) ABSTRACT

A method of producing a fine fiber, including treating a cellulose raw material with an enzyme; and fibrillating the treated cellulose raw material; treating with the enzyme under a condition where at least a ratio of endo-glucanase activity to cellobiohydrolase activity that is 0.06 or greater. The cellulose raw material may be a plant fiber. The method efficiently produces a fine fiber from a cellulose raw material at low cost and with a low environmental burden, a fine fiber, and a non-woven fabric.

3 Claims, 2 Drawing Sheets

(56) References Cited

OTHER PUBLICATIONS

International Search Report issued in PCT/JP2013/063664 dated Jun. 11, 2013.
Siqueira, G., Morphological Investigation of Nanoparticles Obtained From Combined Mechanical Shearing, and Enzymatic and Acid Hydrolysis of Sisal Fibers, Cellulose 17:1147-1158, 2010.
Office Action in Japanese Patent Application No. 2014-516773, dated Jun. 6, 2017.
Hayashi, T., Method for Producing Cellulose Nanofibers Using Enzyme Hydrolysis, Magazine of the Society of Rubber Science and Technology 85(12):32-37, 2012.
Office Action dated May 30, 2017, received in Japanese Patent Application No. 2014-516773.
Vlasenko, E., et al., Substrate Specificity of Family 5, 6, 7, 9, 12, and 45 Endoglucanases, Bioresource Technology 101(2010), pp. 2405-2411.
International Standard, First Edition, ISO 4046-2, Paper, Board, Pulps and Related Terms—Vocabulary—Part 2: Pulping Terminology, p. 3, Oct. 1, 2002.
Japanese Industrial Standards, P 0001, Paper, Board and Pulp—Vocabulary, pp. 17-19 and 24-25, 1998.

* cited by examiner

METHOD OF PRODUCING FINE FIBER, AND FINE FIBER, NON-WOVEN FABRIC, AND FINE FIBROUS CELLULOSE

TECHNICAL FIELD

The present invention relates to a method of producing a fine fiber using enzymes, a fine fiber and a non-woven fabric obtained by the production method, and fine fibrous cellulose.

The present application claims priority to Japanese Patent Application No. 2012-115411 filed May 21, 2012, and Japanese Patent Application No. 2012-178344 filed Aug. 10, 2012, the entire contents of which are hereby incorporated herein by reference.

BACKGROUND ART

Recently, materials that use recyclable natural fibers have received attention due to increasing environmental awareness and for the purpose of substituting petroleum resources. Among natural fibers, a cellulose fiber having a fiber diameter of 10 to 50 μm, particularly, a tree-derived cellulose fiber (pulp), has been widely used mainly as a paper product. In addition, cellulose fibers that are fine fibers having a fiber diameter of 1 μm or less are also known, and a sheet containing these fine fibers has advantages such as a high mechanical strength. Therefore, applications of these to various purposes have been investigated. For example, a use of the fine fiber where the fine fiber is made into a non-woven fabric and utilized as a high-strength sheet has been known. In addition, when the fine fiber is composited with a polymer, heat resistant dimensional stability is significantly enhanced due to more uniform, finer dispersion of the fine fiber in the polymer. Such composite materials can be used in various structural members, and great expectation surrounds their applications as organic ELs or flexible transparent substrates for liquid crystal displays.

Patent Document 1 and Patent Document 2 disclose methods of producing fine fibers that micronize fibers by utilizing a function of cellulase enzyme that selectively cuts the amorphous region of a cellulose fiber and a function of xylanase or hemicellulase that selectively cuts a xyloglucan or hemicellulose component that serves as an adhesive between microfibrils.

Patent Document 3 and Patent Document 4 attempted micronizing the fiber by using an endo-glucanase type cellulase enzyme.

In addition, fine fibrous cellulose having a fiber diameter in the order of nanometers is known as a cellulose fiber (Patent Documents 5, 6, and 7). For example, Patent Document 5 discloses a fine fibrous cellulose having a degree of polymerization of 500 or greater obtained by fibrillating beaten pulp. Patent Document 6 discloses a fine fibrous cellulose having a degree of polymerization of 600 or greater obtained by fibrillating a cellulose raw material in an ionic liquid. Patent Document 7 discloses a fine fibrous cellulose obtained by treating a cellulose raw material with N-oxyl and a cooxidation agent such as sodium hypochlorite to fibrillate the cellulose raw material. The treatment using N-oxyl and a cooxidation agent of Patent Document 7 oxidizes a hydroxy group of cellulose to form carboxy group.

Recently, applications of fine fibrous cellulose to various purposes have been investigated. For example, it has been investigated in order to obtain a fiber reinforced resin composite by dehydrating after mixing fine fibrous cellulose with an emulsion resin.

PRIOR ART DOCUMENTS

Patent Documents

Patent Document 1: Japanese Unexamined Patent Application Publication No. 2008-075214A Patent Document 2: Japanese Unexamined Patent Application Publication No. 2008-169497A Patent Document 3: Japanese Unexamined Patent Application Publication No. 2008-150719A Patent Document 4: Japanese Unexamined Patent Application Publication (Translation of PCT Application) No. 2009-526140A Patent Document 5: Japanese Unexamined Patent Application Publication No. 2012-036529A Patent Document 6: Japanese Unexamined Patent Application Publication No. 2011-184816A Patent Document 7: Japanese Unexamined Patent Application Publication No. 2011-184825A

SUMMARY OF THE INVENTION

Problems to be Solved by the Invention

The production methods of Patent Documents 1 to 4, however, result in low efficiencies when produced from fiber raw material and high costs due to the insufficient micronization of the cellulose raw material, the low yield of the fine fiber, and the insufficient stability of the dispersion liquid.

Typically, fine fibrous cellulose is obtained in the form of slurry. However, fine fibrous celluloses described in Patent Documents 5 and 6 have low fluidity when made into slurries, and the viscosity of the slurry can be high.

Fine fibrous cellulose described in Patent Document 7 has low filterability, and when the fine fibrous cellulose is made into a sheet, the production of the sheet is difficult and results in poor productivity. Even when a sheet is obtained, the sheet tends to turn yellow over time. In addition, the slurry of the fine fibrous cellulose described in Patent Document 7 has high viscosity, and it was difficult to obtain a highly concentrated product thereof.

Furthermore, fine fibrous celluloses described in Patent Documents 5 to 7 readily form aggregate when mixed with an emulsion resin.

An object of the present invention is to provide a method of producing a fine fiber and a fine fiber obtained by the production method that resolve the problems described above.

In addition, another object of the present invention is to provide a fine fibrous cellulose that has high fluidity when made into a slurry, has low viscosity and excellent filterability, hardly turns yellow, and, when mixed with an emulsion resin, hardly forms aggregate.

Means to Resolve the Problems

As a result of diligent research on the method of producing a fine fiber by an enzyme treatment, the present inventors have found the following. With a method, such as a conventional method, of micronizing the fiber by mechanical force after treating a cellulose raw material using endo-glucanase having a function that selectively cuts the amorphous region of a cellulose fiber, xylanase or hemicellulase having functions that selectively cut a xyloglucan or hemicellulose component that serves as an adhesive between microfibrils, the yield of the fine fiber is low, the length of the obtained fine fiber is short, and the aspect ratio is also relatively small. With the present invention, by using, during an enzyme treatment, an enzyme containing both the endoglucanase described above and cellobiohydrolase having a function that selectively cuts the crystalline region, the yield of the fine fiber is significantly improved, and a fine fiber having a long fiber length and a relatively large aspect ratio can be obtained.

The present invention includes, for example, each of the following inventions.

(1) A method of producing a fine fiber, the method comprising the steps of: (a) treating a cellulose raw material with enzymes; and (b) fibrillating the treated cellulose raw material; the step of treating with the enzymes comprising treating under a condition where at least a ratio of EG activity to CBHI activity of the enzymes is 0.06 or greater.

(2) The method of producing a fine fiber according to (1) wherein the cellulose raw material is selected from plant fibers.

(3) A fine fiber obtained by the production method described in any one of (1) and (2).

(4) A non-woven fabric comprising a fine fiber described in (3).

The fine fibrous cellulose of the present invention has an average fiber width of 1 to 1000 nm, a degree of polymerization of greater than or equal to 50 and less than 500, and an acid group content of 0.1 mmol/g or less.

The fine fibrous cellulose of the present invention preferably has an average aspect ratio of 10 to 1000.

In addition, the present invention has aspects described below.

[1] A method of producing a fine fiber, the method comprising the steps of: (a) treating a cellulose raw material with enzymes; and (b) fibrillating the treated cellulose raw material; the (a) treating a cellulose raw material with enzymes comprising treating under a condition where a ratio of an activity of endo-glucanase to an activity of cellobiohydrolase, both at least contained in the enzyme, is 0.06 or greater.

[2] The method of producing a fine fiber according to [1], wherein the (a) treating a cellulose raw material with enzymes comprises treating under a condition where a ratio of an activity of β-glucosidase to the activity of the cellobiohydrolase contained in the enzyme is 0.30 or less.

[3] The method of producing a fine fiber according to [1] wherein the cellulose raw material is selected from plant fibers.

[4] A fine fiber obtained by the production method described in any one of [1] to [3].

[5] A non-woven fabric comprising a fine fiber described in [4].

[6] A fine fibrous cellulose having an average fiber width of 1 to 1000 nm, a degree of polymerization of greater than or equal to 50 and less than 500, and an acid group content of 0.1 mmol/g or less.

[7] The fine fibrous cellulose according to [6], wherein an average aspect ratio is from 10 to 10000.

The EG activity (endo-glucanase activity) of the present invention was measured and defined as described below. The endo-glucanase activity of the present invention means an activity of hydrolyzing a glycosidic bond of β-1,4-glucan at an amorphous region of the β-1,4-glucan.

A substrate solution (containing an acetic acid-sodium acetate buffer solution having a concentration of 100 mM and a pH of 5.0) of carboxymethylcellulose having a concentration of 1% (W/V) (CMCNa High viscosity; Cat. No. 150561, MP Biomedicals, Inc.) was prepared. An enzyme for measurement was diluted in advance with the buffer solution (the same as described above; dilution rate was adjusted so that the absorbance of the enzyme solution described below is in the range of the calibration curve obtained from the glucose standard solutions described below). 10 μL of the enzyme solution obtained by the dilution was added to 90 μL of the substrate solution, and the mixture was reacted for 30 minutes at 37° C.

To create a calibration curve, 100 μL each of ion exchanged water (blank) and glucose standard solutions (at least four standard solutions having different concentrations selected from the concentrations of 0.5 to 5.6 mM) were prepared and maintained at 37° C. for 30 minutes.

300 μL of a DNS coloring solution (1.6 mass % of NaOH, 1 mass % of 3,5-dinitro salicylic acid, and 30 mass % of potassium sodium tartrate) was added to each of the enzyme-containing solution after the reaction, and the blank and the glucose standard solutions for the calibration curve, and the mixture was boiled for five minutes to develop color. After developing color, the mixture was immediately cooled with ice, and 2 mL of ion exchanged water was added thereto and mixed well. After being left standing for 30 minutes, absorbance was measured within one hour.

Absorbance at 540 nm was measured using a microplate reader (infinite M200; manufactured by TECAN) by dispensing 200 μL into a 96-well MicroWell Plate (269620; manufactured by NUNC).

A calibration curve was created using glucose concentrations and absorbances of glucose standard solutions in which the absorbance of the blank was subtracted. The produced glucose equivalent in the enzyme solution was calculated by using a calibration curve after subtracting the absorbance of the blank from the absorbance of the enzyme solution (if the absorbance of the enzyme solution is not in the range of the calibration curve, another measurement is performed by changing the dilution rate when the enzyme is diluted with the buffer solution). An amount of the enzyme producing 1 μmol of glucose equivalent of reducing sugar per one minute was defined as 1 unit. The EG activity of the present invention was calculated from the equation below.

EG activity=[produced glucose equivalent of 1 mL of enzyme solution obtained by diluting with a buffer solution (μmol)/30 min.]×dilution rate (refer to Sakuzo FUKUI, "Experimental Methods of Biochemistry (Quantitative Determination of Reducing Sugar) 2nd Ed.," Gakkai Shuppan Center, p. 23-24 (1990))

The CBHI activity (cellobiohydrolase activity) of the present invention was measured and defined as described below. The cellobiohydrolase activity of the present invention means an activity of hydrolyzing a glycosidic bond of β-1,4-glucan at least one of reducing terminal and non-reducing terminal.

In a 96-well MicroWell Plate (269620, manufactured by NUNC), 32 μL of 1.25 mM 4-methyl-umberiferyl-cellobioside (dissolved in an acetic acid-sodium acetate buffer solution having a concentration of 125 mM, and a pH of 5.0) was dispensed, and 4 μL of 100 mM glucono-1,5-lactone was added. Then, 4 μL of the enzyme solution for measurement diluted with the buffer solution that is the same as described above (dilution rate was adjusted so that the fluorescence/luminescence of the enzyme solution described below is in the range of the calibration curve obtained from the standard solutions described below) was added to the mixture and reacted at 37° C. for 30 minutes. Thereafter, 200

μL of a 500 mM glycine-NaOH buffer solution (pH 10.5) was added, and the reaction was stopped.

As standard solutions for the calibration curve, in the 96-well MicroWell Plate that is the same as described above, 40 μL each of 4-methyl-umberiferon standard solutions (at least four standard solutions having different concentrations selected from the concentrations of 0 to 50 μM) was dispensed and heated at 37° C. for 30 minutes. Thereafter, 200 μL of a 500 mM glycine-NaOH buffer solution (pH 10.5) was added.

Fluorescence/luminescence at 350 nm (excitation light: 460 nm) was measured using a microplate reader (Fluoroskan A scent FL; manufactured by Thermo-Labsystems). Produced amount of the 4-methyl-umberiferon in the enzyme solution was calculated using the calibration curve created from the data of the standard solutions (if the fluorescence/luminescence of the enzyme solution is not in the range of the calibration curve, another measurement is performed by changing the dilution rate). An amount of the enzyme producing 1 μmol of 4-methyl-umberiferon per one minute is defined as 1 unit. The CBHI activity of the present invention was calculated from the equation below.

CBHI activity=[produced amount of 4-methyl-umberiferon from 1 mL of enzyme solution after dilution(μmol)/30 min.]×dilution rate β-glucosidase activity (BGL activity) of the present invention was measured as described below. The β-glucosidase activity of the present invention means an activity of hydrolyzing a β-glycosidic bond of sugar.

Measurement of the β-glucosidase activity was performed as described below. In 16 μL of 125 mM acetic acid buffer containing 1.25 mM 4-methyl-umberiferyl-glucoside (pH 5.0), 4 μL of an enzyme solution was added and reacted at 37° C. for 10 minutes. Thereafter, 100 μL of a 500 mM glycine-NaOH buffer solution (pH 10.0) was added and the reaction was stopped. The fluorescence intensity at 460 nm was measured using the excitation light at 350 nm.

Effects of the Invention

With the method of producing a fine fiber of the present invention, a cellulose raw material can be sufficiently micronized, and the yield of the fine fiber is high. Therefore, the method of the present invention is highly efficient in producing a fine fiber from a cellulose raw material. The fine fiber obtained by the production method of the present invention has a long fiber length, and is characterized by a relatively large aspect ratio. A non-woven fabric containing the fine fiber has high strength. In addition, the production method of the present invention results in a low cost and a low environmental burden.

The fine fiber and the fine fibrous cellulose of the present invention have high fluidity when made into a slurry, have low viscosity and excellent filterability, hardly turn yellow, and, when mixed with an emulsion resin, hardly form aggregate.

DETAILED DESCRIPTION OF THE INVENTION

Figure 1:
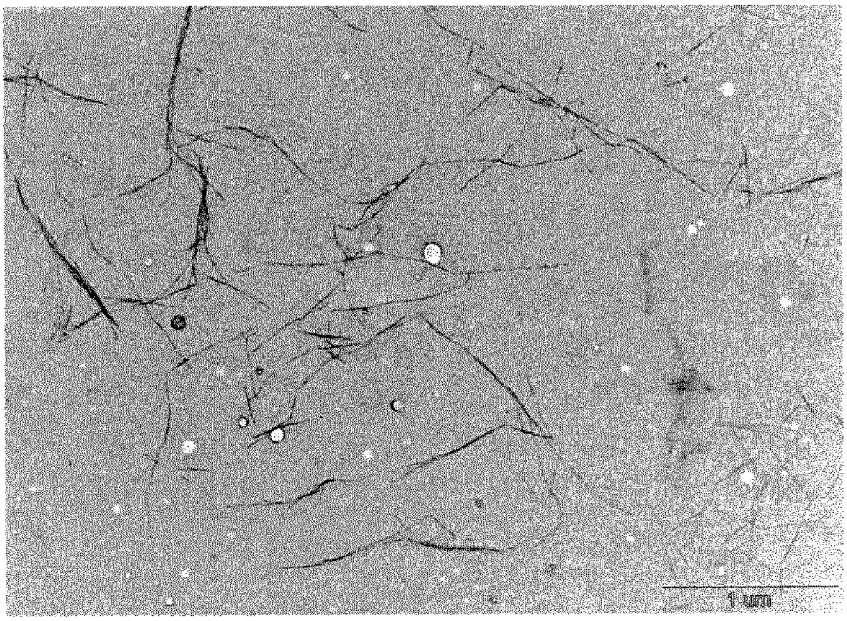
FIG. 1 is a transmission electron photomicrograph of fine fibers obtained in Working Example 1.

The fine fiber of the present invention is typically fine fibrous cellulose in which the fiber is formed from cellulose, and the maximum fiber width, in the case where the minor axis of the fine fiber is taken to be a width, is from 1 nm to 1500 nm, and the fiber length, in the case where the major axis of a fine fiber is taken to be a length, is from 0.03 μm to 5 μm.

[Fine Fiber]

The fine fiber of one aspect of the present invention is a cellulose fiber that is significantly finer than pulp fibers typically used in papermaking or a rodlike particle of cellulose.

An average fiber width of the fine fiber and the fine fibrous cellulose is measured by an observation using an electron microscope as described below. A sample for observation via transmission electron microscope (TEM) is obtained by preparing a slurry containing fine cellulose fiber, and casting the slurry over a hydrophilization-treated carbon film-covered grid. In the case where wide fibers are contained, an image obtained by a scanning electron microscope (SEM) of the surface of the slurry casted over glass may be observed. Depending on the width of the constituting fibers, the observation is performed using an image obtained by an electron microscope at any of magnifications of 1000×, 5000×, 10000×, 20000×, 40000×, 50000×, and 100000×. However, samples, observation conditions, and magnification are adjusted to satisfy the conditions (1) and (2) below.

(1) When a straight line X is drawn at an arbitrary position on the image for observation, 20 or more fibers cross the straight line X.

(2) When a straight line Y that intersects the straight line X perpendicularly is drawn on the same image, 20 or more fibers cross the straight line Y.

From the above described electron microscope images for observation, fiber widths (minor axis of a fiber) of at least 20 fibers crossing the straight line X and at least 20 fibers crossing the straight line Y (that is, the total of at least 40 fibers) are read. In this manner, at least three sets of the above described electron microscope images are observed, and fiber widths of at least 3 sets of 40 fibers (that is, at least 120 fibers) are read. An average fiber width is determined by averaging, that is dividing the total of the fiber widths obtained via the reading in the manner described above by the number of fibers that has been read. This average fiber width is equal to the number average fiber diameter.

In one aspect of the present invention, the average fiber width of the fine fibers observed by an electron microscope is preferably from 1 nm to 1000 nm, more preferably from 2 nm to 500 nm, and further preferably from 4 nm to 100 nm.

In another aspect of the present invention, in the case where the minor axis of a fine fiber is taken to be the width, the maximum fiber width is preferably 1500 nm or less, more preferably 1000 nm or less, and further preferably 200 nm or less.

If the fiber width of the fine fiber is less than 1 nm, the physical properties (strength or stiffness, or dimensional stability) as a fine fiber will not be exhibited due to the fiber being dissolved in water as cellulose molecules. If the average fiber width is greater than 1000 nm, since the fiber is merely a fiber contained in typical pulp, the physical properties (strength or stiffness, or dimensional stability) as a fine fiber will not be obtained.

In the applications where transparency is required for the fine fiber, if the average fiber width is greater than 30 nm, the fiber width approaches 1/10 of the wavelength of visible light, and in the case where the fiber is composited with a matrix material, refraction and scattering of visible light readily occur at the interface, and transparency tends to decrease. Therefore, the average fiber width is preferably from 2 nm to 30 nm, and more preferably from 2 nm to 20 nm. Since the composite material obtained from the fine fiber described above generally has a dense structure, it is possible to achieve high transparency due to less scattering of visible light in addition to achieving a high elastic modulus derived from cellulose crystals and high strength.

<Fine Fibrous Cellulose>

The fine fiber and the fine fibrous cellulose of the present invention are the identical substance.

The fine fibrous cellulose of yet another aspect of the present invention is a cellulose fiber having an I type crystal structure that is significantly finer and shorter than pulp fibers typically used in papermaking or a rodlike particle of cellulose.

In a diffraction profile obtained by wide angle x-ray diffraction image using CuKα(λ=1.5418 Å) monochromatized by graphite, it can be identified that the fine fibrous cellulose has I type crystal structure based on the presence of characteristic peaks at two positions around 2θ=14 to 17° and around 2θ=22 to 23°.

(Fiber Width)

The fine fibrous cellulose of yet another aspect of the present invention is a cellulose having an average fiber width (average fiber diameter) of 1 to 1000 nm determined by the observation using an electron microscope. The average fiber width of the fine fibrous cellulose is preferably 150 nm or less, more preferably 100 nm or less, further preferably 50 nm or less, and most preferably 20 nm or less. If the average fiber width of the fine fibrous cellulose exceeds 1000 nm, it will be difficult to exhibit the properties of the fine fibrous cellulose (high strength or high stiffness, or high dimensional stability).

On the other hand, in yet another aspect of the present invention, the average fiber width of the fine fibrous cellulose is preferably 1 nm or greater, and more preferably 2 nm or greater. If the average fiber width of the fine fibrous cellulose is less than 1 nm, it will be difficult to exhibit the properties of the fine fibrous cellulose (high strength or high stiffness, or high dimensional stability) due to the fibers being dissolved in water as cellulose molecules.

In yet another aspect of the present invention, the range of the average fiber width of the fine fibrous cellulose is preferably from 1 to 1000 nm, more preferably from 1 to 150 nm, further preferably from 1 to 100 nm, particularly preferably from 1 to 50 nm, and most preferably from 1 to 20 nm.

The measurement of the fiber width by observation of a fine fiber using an electron microscope is performed as described below. A sample for observation via TEM is obtained by preparing a slurry containing fine fibers at a concentration of 0.05 to 0.1 mass %, and casting the slurry over a hydrophilization-treated carbon film-covered grid. In the case where wide fibers are contained, an image obtained by a SEM of the surface of the slurry casted over glass may be observed. Depending on the width of the constituting fibers, the observation is performed by an image obtained by an electron microscope at a magnification of 1000× to 100000×.

(Measurement of the Average Fiber Width by Observation of the Fine Fibrous Cellulose Using an Electron Microscope)

The measurement of the average fiber width by observation of a fine fibrous cellulose using an electron microscope is performed as described below. A sample for observation via transmission electron microscope (TEM) is obtained by preparing a slurry containing fine fibrous cellulose, and casting the slurry over a hydrophilization-treated carbon film-covered grid. In the case where wide fibers are contained, an image of the surface of the slurry casted over glass obtained by a scanning electron microscope (SEM) may be observed. Depending on the width of the constituting fibers, the observation is performed by an image obtained by an electron microscope at any of magnifications of 1000×, 5000×, 10000×, 20000×, 50000×, and 100000×.

However, samples, observation conditions, and magnification are adjusted to satisfy the conditions (1) and (2) below.

(1) When a straight line X is drawn at an arbitrary position on the image for observation, 20 or more fibers cross the straight line X.

(2) When a straight line Y that intersects the straight line X perpendicularly is drawn on the same image, 20 or more fibers cross the straight line Y.

From the above described electron microscope images for observation, widths (minor axis of a fiber) of at least 20 fibers crossing the straight line X and at least 20 fibers crossing the straight line Y (that is, the total of at least 40 fibers) are read. In this manner, at least three sets of the above described electron microscope images are observed, and fiber widths of at least 3 sets of 40 fibers (that is, at least 120 fibers) are read. An average fiber width is determined by averaging, that is dividing the total of the fiber widths obtained via the reading in the manner described above by the number of fibers that has been read.

In yet another aspect of the present invention, in the case where the major axis of a fine fiber is taken to be the length, the fiber length is preferably 0.03 μm or greater, and more preferably from 0.03 μm to 5 μm. If the fiber length is less than 0.03 μm, it will be difficult to obtain a non-woven fabric containing the fine fibers or to enhance the strength of a composite material formed by compositing the fine fiber and resin. The fiber length can be determined by analyzing an image of TEM, SEM, or AFM.

In yet another aspect of the present invention, in the case where the minor axis of a fine fibrous cellulose is taken to be the width, the maximum fiber width is preferably 1 nm or greater and 1000 nm or less, more preferably 1 nm or greater and 500 nm or less, and most preferably 1 nm or greater and 200 nm or less. As long as the maximum fiber width of the fine fibrous cellulose is 1000 nm or less, the strength of a composite resin obtained by mixing the fine fibrous cellulose and an emulsion resin will be high, the transparency of the composite resin will be easily ensured, and thus the fine fibrous cellulose is preferable for applications requiring transparency.

(Degree of Polymerization)

Degree of polymerization of fine fibrous cellulose means the number of glucose molecule contained in one molecule of cellulose.

In yet another aspect of the present invention, the degree of polymerization of the fine fibrous cellulose is 50 or greater and less than 500, and preferably from 100 to 450, and more preferably from 150 to 300. If the degree of polymerization of the fine fibrous cellulose is less than 50, the fine fibrous cellulose cannot be said to be "fibrous", and will be difficult to use as a reinforcing agent. On the other hand, if the degree of polymerization of the fine fibrous cellulose is 500 or greater, when the fine fibrous cellulose is made into a slurry, the fluidity of the fine fibrous cellulose will be reduced and the dispersion stability will be lowered due to the excessively high slurry viscosity. In addition, an aggregate may be formed when the fine fibrous cellulose having a degree of polymerization of 500 or greater is mixed with an emulsion resin.

(Measurement of Degree of Polymerization)

The degree of polymerization of fine fibrous cellulose is measured by the method described below.

A fine fibrous cellulose (supernatant solution obtained after centrifugation; concentration: about 0.1 mass %) is spread out in a petri dish formed from polytetrafluoroethylene, and dried at 60° C. to obtain a dried sheet. The obtained dried sheet is dispersed in a dispersing medium, and the pulp viscosity is measured in accordance with Tappi T230. The blank viscosity is also measured by performing a blank test in which the viscosity is measured using the dispersing medium alone. Specific viscosity ($\eta sp$) is determined by subtracting 1 from a value obtained by dividing the pulp viscosity by the blank viscosity. Intrinsic viscosity ($[\eta]$) is calculated using the equation below.

$$[\eta]=\eta sp/(c(1+0.28\times\eta sp))$$

In the equation, c represents the cellulose concentration at the time of the viscosity measurement.

Thereafter, the degree of polymerization (DP) of the present invention is calculated from the equation below.

$$DP=1.75\times[\eta]$$

Since this degree of polymerization is also the average degree of polymerization measured according to viscometry, this degree of polymerization is also called "viscosity average degree of polymerization."

(Average Fiber Length)

In yet another aspect of the present invention, in the case where the major axis of a fine fibrous cellulose is taken to be the length, the average fiber length is preferably from 0.03 to 5 μm, and more preferably from 0.1 to 2 μm. As long as the average fiber length is 0.03 μm or greater, the strength can be enhanced when the fine fibrous cellulose is compounded in a resin. As long as the average fiber length is 5 μm or less, the dispersibility will be good when the fine fibrous cellulose is compounded in a resin. The fiber length can be determined by analyzing an electron microscope image for observation used during the average fiber width measurement described above. That is, from the above described electron microscope images for observation, fiber lengths of at least 20 fibers crossing the straight line X and at least 20 fibers crossing the straight line Y (that is, the total of at least 40 fibers) are read. In this manner, at least three sets of the above described electron microscope images are observed, and fiber lengths of at least 3 sets of 40 fibers (that is, at least 120 fibers) are read. An average fiber length is determined by averaging, that is dividing the total of the fiber lengths obtained via the reading in the manner described above by the number of fibers that has been read.

In yet another aspect of the present invention, the aspect ratio of the fine fiber of the present invention is also described as, in the present specification, axial ratio for example, and is represented by the ratio "fiber length/fiber width". The aspect ratio of the fine fiber according to the present invention is preferably in a range of 10 to 10000, and more preferably in a range of 25 to 1000. If the axial ratio is less than 20, it will be difficult to form a fine fiber-containing non-woven fabric. If the axial ratio exceeds 10000, the slurry viscosity will be high, which is not preferable.

(Average Aspect Ratio)

In yet another aspect of the present invention, the average aspect ratio of the fine fibrous cellulose is preferably in a range of 10 to 10000, and more preferably in a range of 25 to 1000, and further preferably in a range of 10 to 300, and most preferably in a range of 50 to 200. If the average aspect ratio is 10 or greater, the fine fibrous cellulose will be more preferable as a reinforcing agent for resins or rubber. If the average aspect ratio is 10000 or less, the viscosity of the fine fibrous cellulose will be lower when the fine fibrous cellulose is made into a slurry.

The average aspect ratio is determined by the method described below.

That is, from the fibers observed using the electron microscope images, 40 fibers are randomly selected, and the aspect ratio (i.e. the ratio "fiber length/fiber width") of each fiber is determined. The average aspect ratio of the present invention is an average of the aspect ratios of the 40 fibers.

(Acid Group Content)

In yet another aspect of the present invention, an acid group content of the fine fibrous cellulose of the present invention means the content of acid group(s) relative to the unit mass of the fine fibrous cellulose.

The acid group content of the fine fibrous cellulose of the present invention is 0.0001 mmol/g or greater and 0.1 mmol/g or less, and preferably 0.0001 mmol/g or greater and 0.06 mmol/g or less. If the acid group content exceeds 0.1 mmol/g, the fine fibrous cellulose tends to hold moisture and results in having insufficient filterability. Therefore, when the fine fibrous cellulose is made into a sheet, the productivity will be low and the production of sheet will be difficult. In addition, if the acid group content exceeds 0.1 mmol/g, the fine fibrous cellulose readily turns yellow.

The acid group refers to a functional group exhibiting acidity, such as a carboxylic acid group, a phosphoric acid group, and a sulfonic acid group. Cellulose contains a little amount of (specifically, 0.1 mmol/g or less) carboxy group without applying a carboxy group introduction treatment. Therefore, the acid group content of the fine fibrous cellulose of the present invention being 0.1 mmol/g or less means that any additional acid group is substantially not introduced into the cellulose. A phosphoric acid group is introduced into cellulose by acting phosphorus oxoacid having at least $(HPO_4)^{2-}$ or the salt thereof. A sulfonic acid group is introduced into cellulose by acting sulfur oxoacid having at least $(HSO_3)^-$ or the salt thereof.

(Measurement of Acid Group Content)

The acid group content is determined using the method "Test Method T237 cm-08 (2008): Carboxyl Content of pulp" of TAPPI in the U.S. In the present invention, the method is in accordance with "TAPPI T237 cm-08 (2008)" except for, in order to measure a greater range of acid group content, among the test solutions used in the above test method, the test solution containing 0.84 g/5.85 g of sodium bicarbonate ($NaHCO_3$)/sodium chloride (NaCl) dissolved and diluted with 1000 mL of distilled water was changed to 1.60 g of sodium hydroxide so that the concentration of the test solution substantially increases four-fold. In addition, in the case where an acid group is introduced, the substantial acid group content is a difference between the measured values of the cellulose fiber before and after the acid group introduction. An absolute dry cellulose fiber of the measurement sample is an absolute dry cellulose fiber obtained by freeze-drying to avoid deterioration in cellulose which may occur due to heat during heat-drying.

Since this measurement method of the acid group content is a measurement method for monovalent acid group (carboxy group), in the case where an acid group to be quantified is a poly acid, the acid group content is a numerical value obtained by dividing the value obtained as a monovalent acid group content by the acid value.

In yet another aspect of the present invention, proportion of the crystal part contained in the fine fiber, in terms of crystallinity determined by X-ray diffraction method, is preferably 60% or greater and 99% or less, more preferably 65% or greater and 99% or less, and further preferably 70% or greater and 99% or less. If the crystallinity is high, excellent performances are expected from the perspectives of exhibition of heat resistance and low coefficient of linear thermal expansion of a composite material in which the fine fibers and a resin are composited.

In yet another aspect of the present invention, the crystallinity of the fine fibrous cellulose of the present invention determined by X-ray diffraction method is preferably 65% or greater and 99% or less, more preferably 70% or greater and 99% or less, further preferably 75% or greater and 99% or less, and most preferably greater than 80% and 99% or less. If the crystallinity is 65% or greater, excellent performances are expected in terms of exhibition of elastic modulus, heat resistance, or low coefficient of linear thermal expansion.

The crystallinity can be determined by a conventional method using a pattern of X-ray diffraction profile measurements (Segal et al., Textile Research Journal, vol. 29, p. 786, 1959).

[Cellulose Raw Material]

Examples of a cellulose raw material or a fine fibrous cellulose raw material for obtaining the fine fiber (hereinafter "cellulose raw material") include pulp for papermaking, cotton pulp such as cotton linters or cotton lint, non-wood pulp such as hemp, straw, or bagasse, cellulose isolated from sea squirts, seaweed or the like, and the like. Of these, from the perspectives of availability, pulp for papermaking is preferable. Examples of pulp for papermaking include hardwood kraft pulp (bleached kraft pulp (LBKP), unbleached kraft pulp (LUKP), oxygen bleached kraft pulp (LOKP), and the like); softwood kraft pulp (bleached kraft pulp (NBKP), unbleached kraft pulp (NUKP), oxygen bleached kraft pulp (NOKP), and the like); chemical pulp such as sulfite pulp (SP) and soda pulp (AP); semichemical pulp such as semichemical pulp (SCP) and chemiground pulp (CGP); mechanical pulp such as groundwood pulp (GP) and thermomechanical pulp (TMP or BCTMP); non-wood pulp in which the raw material is paper mulberry, mitsumata, hemp, kenaf, or the like; and deinked pulp in which the raw material is a used paper. Of these, from the perspectives of availability, kraft pulp, deinked pulp, and sulfite pulp are preferable.

One type of the cellulose raw material may be used alone, or two or more types may be used in combination.

In yet another aspect of the method of producing a fine fiber of the present invention, the cellulose raw material for obtaining a fine fiber may be selected from plant fibers, and preferably selected from lignocellulose raw material.

Examples of lignocellulose raw material include pulp for papermaking, cotton pulp such as cotton linters or cotton lint, non-wood pulp such as hemp, straw, or bagasse, cellulose isolated from sea squirts, seaweed or the like, and the like. Of these, from the perspectives of availability, pulp for papermaking is preferable. Examples of pulp for papermaking include hardwood kraft pulp (bleached kraft pulp (LBKP), unbleached kraft pulp (LUKP), oxygen bleached kraft pulp (LOKP), and the like); softwood kraft pulp (bleached kraft pulp (NBKP), unbleached kraft pulp (NUKP), oxygen bleached kraft pulp (NOKP), and the like); chemical pulp such as sulfite pulp (SP) and soda pulp (AP); semichemical pulp such as semichemical pulp (SCP) and chemiground wood pulp (CGP); mechanical pulp such as groundwood pulp (GP) and thermomechanical pulp (TMP or BCTMP); non-wood pulp in which the raw material is paper mulberry, mitsumata, hemp, kenaf, or the like; and deinked pulp in which the raw material is a used paper. Of these, from the perspectives of availability, kraft pulp, deinked pulp, and sulfite pulp are preferable. One type of the cellulose raw material may be used alone, or two or more types may be used in combination.

[Production of Fine Fiber]

Production steps of the fine fiber of yet another aspect of the present invention will be described in detail.

<Step (a)>

In the present invention, although the cellulose raw material may be used as is, the cellulose raw material is preferably fed to an enzyme treatment step after undergoing a mechanical crushing treatment in order to enhance the enzyme reaction efficiency. The crushing method may be a dry method or a wet method. A disintegrator that disaggregates pulp or a refiner that beats pulp may be used. A crusher can be appropriately selected, depending on the end use or costs, from shearing type crushers such as a grinder, pressure homogenizer, shredder, and cutter mill, compression type crushers such as a jaw crusher and cone crusher, impact type crushers such as an impact crusher, intermediate crushers such as a roll mill, stamp mill, edge-runner mill, and rod mill.

Using a solvent, preferably water, the cellulose raw material is prepared into a dispersion liquid containing 0.2 to 20 mass % of the cellulose raw material, or preferably 1 to 10 mass % of the cellulose raw material, relative to the total mass of the cellulose raw material and the solvent. Before or after adding an enzyme to the dispersion liquid, the temperature and pH of the dispersion liquid is appropriately adjusted. From the perspective of better reaction efficiency, the enzyme is preferably added after adjusting the temperature and pH. In the present invention, some or all of the enzyme may be added to the solvent in advance.

The enzymes used in the present invention is cellulase enzymes, and are classified into the glycoside hydrolase family based on higher order structure of catalytic domain having a function for hydrolysis reaction of cellulose. The cellulase enzymes are classified into endo-glucanase and cellobiohydrolase depending on cellulose decomposition properties. Endo-glucanase has high hydrolyzability to an amorphous part of cellulose, soluble cellooligosaccharide, or cellulose derivatives such as carboxymethylcellulose, and randomly cuts the molecular chains of these from inside and reduces the degrees of polymerization thereof. However, endo-glucanase has low hydrolyzability to cellulose microfibril having crystalline properties. On the other hand, cellobiohydrolase decomposes the crystal part of cellulose and yields cellobiose. In addition, cellobiohydrolase hydrolyzes a cellulose molecule from its terminal and is also called exo-type or processive enzyme.

In the method of producing a fine fiber in yet another aspect of the present invention, the method comprises a step of treating a cellulose raw material with enzymes, and the step of treating a cellulose raw material with enzymes comprising treating under a condition where a ratio of an activity of endo-glucanase to an activity of cellobiohydrolase, both at least contained in the enzyme, is 0.06 or greater.

The step of treating a cellulose raw material with enzymes means reacting a cellulose raw material with enzymes by adding the enzymes into a dispersion liquid containing the cellulose raw material.

The EG activity of the present invention is the endo-glucanase activity and has a function of selectively cutting the amorphous region of a cellulose fiber. The CBHI activity is the cellobiohydrolase activity, and has a function of selectively cutting the crystalline region of a cellulose fiber. In the present invention, an enzyme or enzyme mixture (e.g. a mixture of two or more types of enzymes) that contains at least endo-glucanase and cellobiohydrolase as cellulase enzymes is used. In yet another aspect of the present invention, when an enzyme is added to a cellulose raw material, the ratio of EG activity to CBHI activity (EG activity/CBHI activity) of the added enzyme or enzyme mixture is 0.06 or greater, preferably 0.1 or greater, and more preferably 1 or greater. The ratio of the EG activity to the CBHI activity is preferably 20 or less, more preferably 10 or less, and most preferably 6 or less.

The range of the ratio of the EG activity to the CBHI activity is preferably from 0.06 to 20, more preferably from 0.1 to 10, and further preferably from 1 to 6.

If the ratio of the EG activity to the CBHI activity is less than 0.06, the aspect ratio of the cellulose fiber after the enzyme treatment will be small and the yield of the cellulose fiber will be low. In addition, the used amount of the enzyme is preferably in a range that is economically efficient. Specifically, in terms of EG activity, it is 0.0001 unit or greater and 100 unit or less, and further preferably 0.001 unit or greater and 10 unit or less, relative to 1 g of the substrate. Since properties vary depending on enzymes, this added amount may not always be appropriate. However, the added amount of an enzyme is preferably adjusted so that the yield of cellulose fibers after the enzyme treatment exceeds 60% because the yield of the cellulose fibers decreases due to saccharification. The added amount of the enzymes is further preferably adjusted so that the yield of the cellulose fibers exceeds 70%.

In addition, in yet another aspect of the present invention, the ratio of β-glucosidase activity (BGL activity) to cellobiohydrolase activity (CBHI activity) contained in the enzyme used in the enzyme treatment of the present invention is preferably 0.000001 or greater and 0.30 or less, further preferably 0.000001 or greater and 0.20 or less, and particularly preferably 0.000001 or greater and 0.10 or less. If the ratio of β-glucosidase activity to cellobiohydrolase activity contained in the enzyme used in the enzyme treatment of the present invention exceeds 0.30, it is not preferable since saccharides released from cellulose will be decomposed to monosaccharides.

In the present invention, in addition to endo-glucanase and cellobiohydrolase, a hemicellulase enzyme may be contained in the enzyme or enzyme mixture used. Among the hemicellulase enzymes, xylanase which is an enzyme decomposing xylan, mannase which is an enzyme decomposing mannan, and arabanase which is an enzyme decomposing araban are exemplified. Pectinase which is an enzyme decomposing pectin can be also used as hemicellulase enzyme. Many of microorganisms generating the hemicellulase enzyme also generate cellulase enzymes.

Hemicellulose is a type of polysaccharides present in cellulose microfibril of plant cell walls except pectins. There are various types of hemicellulose, and hemicellulose varies depending on the type of plant or the layer of cell walls. Among woods, a secondary wall of softwood contains glucomannan as a main component, and a secondary wall of hardwood contains 4-O-methyl glucurono xylan as a main component. Therefore, to obtain fine fibers from softwood, it is preferable to use mannase, and to obtain fine fibers from hardwood, it is preferable to use xylanase.

pH of the cellulose raw material-containing dispersion liquid for the enzyme treatment of the present invention is preferably maintained at an appropriate pH for the enzyme used. For example, when a commercially available enzyme derived from *Trichoderma* is used, pH is preferably from 4 to 8. In the appropriate pH range of the enzyme, activity is high and an enzyme reaction can be performed efficiently. The temperature of the cellulose raw material-containing dispersion liquid for the enzyme treatment of the present invention is preferably maintained at an appropriate temperature for the enzyme used in the enzyme treatment step. For example, when a commercially available enzyme derived from *Trichoderma* is used, the temperature is preferably from 40° C. to 50° C. In addition, for enzymes derived from mold, it is generally preferable to maintain the enzyme at 30° C. to 50° C. The temperature of the cellulose raw material-containing dispersion liquid for the enzyme treatment of less than 30° C. is not preferable because the enzyme activity decreases and thus time required for the treatment will be longer. If the temperature of the cellulose raw material-containing dispersion liquid for the enzyme treatment exceeds 70° C., the enzyme may be deactivated. Treating time of the enzyme treatment step of the present invention is preferably in a range of 10 minutes to 24 hours. In the case where the treating time is less than 10 minutes, it is difficult for the effect of the enzyme treatment to be exhibited. In the case where the treating time exceeds 24 hours, decomposition of the cellulose fiber proceeds excessively by the enzyme and the weighted average fiber length of the obtained fine fiber may be too short.

Since, if active enzymes remain after a desired time period, the cellulose fiber decomposition proceeds excessively as described above, the cellulose raw material-containing dispersion liquid is preferably washed with water after reacting with the enzyme to avoid residual enzymes. The cellulose raw material-containing dispersion liquid is preferably washed with water at an amount of 2 to 20 times the weight of the cellulose fiber so that the enzyme hardly remains. A method of deactivating the enzyme by adding 20% caustic soda to the cellulose raw material-containing dispersion liquid after reacting with the enzyme so that the pH thereof becomes approximately 12, or alternatively a method of deactivating the enzyme by increasing the temperature of the cellulose raw material-containing dispersion liquid after reacting with the enzyme to 90° C. that is the temperature at which the enzyme is deactivated can be used as typical methods.

<Step (b)>

The cellulose raw material-containing dispersion liquid after reacting with the enzyme is adjusted to 0.1 to 10 mass % using a solvent, preferably water, and then fed to micronizing (fibrillating) treatment. The cellulose concentration contained in the dispersion liquid is preferably from 0.2 to 5 mass %, and more preferably from 0.3 to 3 mass %. If the concentration is less than 0.1 mass %, the treating efficiency will be low. On the other hand, if the concentration exceeds 10 mass %, viscosity will excessively increase during the micronizing treatment, and handling may be difficult.

Micronizing using various mechanical pulverizing apparatus can be used as a method for micronizing the enzyme-treated cellulose raw material. As a pulverizing apparatus, a high speed fibrillating device, high speed rotation type fibrillating device (e.g. CLEARMIX), grinder (stone mill type grinder), high-pressure homogenizer or ultra high-pressure homogenizer, high pressure collision type pulverizer, ball mill, bead mill, disk type refiner, conical refiner, twin screw kneader, oscillating mill, homomixer using high speed rotation, ultrasonic wave disperser, or apparatus for wet grinding such as a beater can be appropriately used. In particular, high-pressure homogenizer, high speed rotation type fibrillating device, or a combined use of these is preferable.

Micronizing is facilitated by a treatment using a high-pressure homogenizer because the cellulose fiber-containing dispersion liquid accelerated to a high speed due to high pressure is micronized by a sudden pressure decrease. By repeating the treatment twice or more times using a high-pressure homogenizer, degree of micronization can be further increased to obtain fine fibers having a desired fiber width. When the number of passes is greater, the degree of micronization can be greater; however, if the number of passes is excessively great, the costs will be high, which is not preferable. Specific examples of the high-pressure homogenizer include homovalve type high-pressure homogenizers represented by Star Burst manufactured by Sugino Machine Limited, High Pressure Homogenizer manufactured by Izumi Food Machinery Co., Ltd., or Mini-Labo 8.3H manufactured by Rannie, or chamber type high-pressure homogenizers such as Microfluidizer manufactured by Microfluidics, a nanomizer manufactured by Yoshida Kikai Co., Ltd., Ultimizer manufactured by Sugino Machine Limited, Genus PY manufactured by Hakusui Chemical Industries, Ltd., DeBEE2000 manufactured by BEE Japan, and Ariete series manufactured by NiroSoavi.

On the other hand, in the case where a high speed rotation type fibrillating device is used, while being rotated at high speed, a cellulose-containing dispersion liquid is passed through a narrow aperture to cause a high sheer rate. Therefore, this is a preferred embodiment because micronizing treatment can be efficiently performed compared to a method that merely rotates at high speed such as a blender treatment. Typical high speed rotation type fibrillating devices include a type in which cellulose fibers to be treated are passed through an aperture between a rotating body and a fixed part to disperse the cellulose fibers, or a type in which an inner rotating body rotating toward a fixed direction, and an outer rotating body rotating toward the opposite direction on the outer side of the inner rotating body are provided, and pulp fibers to be treated are passed through an aperture between the inner rotating body and the outer rotating body to disperse the pulp fibers. Examples of the high speed rotation type fibrillating device include CLEARMIX manufactured by M Technique Co., Ltd., T.K. ROBOMIX or T.K. FILMIX manufactured by PRIMIX Corporation, Milder, Cavitron, or Sharp Flow Mill manufactured by Pacific Machinery and Engineering Co., Ltd., and the like.

In the present invention, the fine fibrous cellulose and another fiber other than the fine fibrous cellulose can be mixed for use. Examples of the fiber other than the fine fibrous cellulose include an inorganic fiber, organic fiber, synthetic fiber and the like, semisynthetic fiber, and recycled fiber. Examples of the inorganic fiber include a glass fiber, rock fiber, metal fiber, and the like; however, the inorganic fiber is not limited to these. Examples of the organic fiber include natural substance-derived fibers such as a carbon fiber, chitin, and chitosan; however, the organic fiber is not limited to these. Examples of the synthetic fiber include nylon, vinylon, vinylidene, polyester, polyolefin (e.g. polyethylene, polypropylene, or the like), polyurethane, acryl, polyvinyl chloride, aramid, and the like; however, the synthetic fiber is not limited to these. Examples of the semisynthetic fiber include an acetate fiber, triacetate fiber, promix, and the like; however, the semisynthetic fiber is not limited to these. Examples of the recycled fiber include rayon, cupra, polynosic rayon, lyocell, tencel, and the like; however, the recycled fiber is not limited to these. In the case where the fine fibrous cellulose and another fiber other than the fine fibrous cellulose are mixed to use, the fiber other than the fine fibrous cellulose can be subjected to a chemical treatment, fibrillating treatment, or the like, as desired. In the case where the fiber other than the fine fibrous cellulose is subjected to a chemical treatment, fibrillating treatment, or the like, the fiber other than the fine fibrous cellulose may be subjected to a chemical treatment, fibrillating treatment, or the like after mixing with the fine fibrous cellulose, or the fiber other than the fine fibrous cellulose may be mixed with the fine fibrous cellulose after being subjected to a chemical treatment, fibrillating treatment, or the like. In the case where the fiber other than the fine fibrous cellulose is mixed, an added amount of the fiber other than the fine fibrous cellulose relative to the total amount of the fine fibrous cellulose and the fiber other than the fine fibrous cellulose is not particularly limited; however, the added amount is preferably 1 mass % or greater and 50 mass % or less, more preferably 1 mass % or greater and 40 mass % or less, further preferably 1 mass % or greater and 30 mass % or less, and particularly preferably 1 mass % or greater and 20 mass % or less.

A fine fiber having a small average fiber diameter and a small maximum fiber diameter can be obtained by performing centrifugation of the obtained fine fiber-containing dispersion liquid via the micronizing treatment.

<Production of Non-Woven Fabric>

A fine fiber-containing non-woven fabric can be produced by using the fine fiber obtained as described above. A fine fiber-containing composite material can be formed by impregnating the obtained non-woven fabric with polymer, or by sandwiching the obtained non-woven fabric by polymer sheets. In the case where the non-woven fabric is produced by filtering the fine fiber-containing dispersion liquid after fibrillating, the fine fiber concentration contained in the dispersion liquid fed to the filtration is preferably from 0.05 to 5 mass %. If the concentration is too low, an enormous amount of time is required for the filtration. On the other hand, if the concentration is too high, it is not preferable since a uniform sheet cannot be obtained. In the case where the dispersion liquid is filtered, it is important for a filter cloth during the filtration that the micronized cellulose fiber does not pass though the filter cloth and the filtration rate does not become too slow. As such a filter cloth, a sheet formed from an organic polymer, fabric, or porous membrane is preferable. As an organic polymer, non-cellulosic organic polymers such as polyethylene terephthalate, polyethylene, polypropylene, and polytetrafluoroethylene (PTFE) are preferable. Specifically, a porous membrane of polytetrafluoroethylene having a pore size of 0.1 to 20 μm (e.g. 1 μm), a fabric of polyethylene terephthalate or polyethylene having a pore size of 0.1 to 20 μm (e.g. 1 μm), or the like are exemplified.

Examples of a method of producing a sheet from a dispersion liquid containing fine fibers include a method using a production apparatus comprising: a water-squeezing section in which a dispersion liquid containing a fine fiber described in WO2011/013567 for example is discharged on a top of an endless belt and a web is formed by squeezing the water from dispersing medium of the dispersion liquid that is discharged; and a drying section for forming a fiber sheet by drying the web; wherein the endless belt is provided from the water-squeezing section to the drying section; and the web formed in the water-squeezing section is transferred to the drying section while being placed on the endless belt; and the like.

In the present invention, examples of the dewatering method that can be used include dewatering methods that are typically used in papermaking. Of these, a method of dewatering using a roll press after dewatering using a fourdrinier, cylinder mold, or inclined wire. In addition, examples of the drying method include methods that are used in papermaking. For example, methods such as a cylinder dryer, yankee dryer, hot air drying, and infrared heater are preferable.

The fine fiber-containing non-woven fabric can have a variety of porosities depending the production method thereof. Examples of a method to obtain a sheet with a high porosity include a method that substitutes water in the non-woven fabric with an organic solvent such as alcohol at the end of a film making step via filtration. This is a method in which water is removed by filtration, and the organic solvent such as alcohol is added when the fine fiber content relative to the total mass of the solvent containing the fine fiber becomes from 5 to 99 mass %. Alternatively, the substitution can be performed also by, after placing the fine fiber-containing dispersion liquid in a filtration apparatus, gently adding an organic solvent such as alcohol on top of the dispersion liquid. In the case where a composite material is obtained by impregnating the fine fiber-containing non-woven fabric with a polymer, if the porosity is low, it will be difficult to impregnate with the polymer. Therefore, the porosity of the fine fiber-containing non-woven fabric is 10 vol. % or greater and 95 vol. % or less, and preferably 20 vol. % or greater and 90 vol. % or less, relative to the total volume of the composite material. Examples of the organic solvent such as alcohol used include, but are not particularly limited to, one or two or more types of organic solvents selected from alcohols such as methanol, ethanol, 1-propanol, 2-propanol, 1-butanol, ethylene glycol, and ethylene glycol mono-t-butyl ether, as well as acetone, methyl ethyl ketone, tetrahydrofuran, cyclohexane, toluene, carbon tetrachloride, or the like. In the case where a water-insoluble organic solvent is used as the organic solvent, the water-insoluble organic solvent is preferably used as a mixed solvent with a water-soluble organic solvent, or the substitution is carried out by using a water-soluble organic solvent and then by using a water-insoluble organic solvent.

The porosity used here refers to a volume fraction of pores in a non-woven fabric, and can be determined by the equation below based on an area, thickness, and mass of the non-woven fabric.

$$\text{Porosity(vol. \%)}=\{1-B/(M\times A\times t)\}\times 100$$

In the equation, A represents an area ($cm^2$) of the non-woven fabric, t represents a thickness (cm), B represents a mass (g) of the non-woven fabric, and M represents a density of cellulose. In the present invention, it is assumed that M=1.5 $g/cm^3$. The film thickness of the non-woven fabric is an average value of 10 measurements performed at various positions on the non-woven fabric using a film thickness meter (PDN-20; manufactured by PEACOCK).

The thickness of the fine fiber-containing non-woven fabric is not particularly limited; however, the thickness is preferably 1 μm or greater, and further preferably 5 μm or greater. In addition, the thickness is typically 1000 μm or less, and preferably from 5 to 250 μm.

The range of the thickness of the fine fiber-containing non-woven fabric is preferably from 1 μm to 1000 μm, and more preferably from 5 μm to 250 μm.

In the present invention, a resin can be mixed into the fine fiber or sheet (non-woven fabric or the like). As the resin, a thermoplastic resin, thermosetting resin, photocurable resin, or the like can be used.

Examples of the thermoplastic resin include a styrene resin, acrylic resin, aromatic polycarbonate resin, aliphatic polycarbonate resin, aromatic polyester resin, aliphatic polyester resin, aliphatic polyolefin resin, cyclic olefin resin, polyamide resin, polyphenylene ether resin, thermoplastic polyimide resin, polyacetal resin, polysulfone resin, amorphous fluorine resin, and the like; however, the thermoplastic resin is not limited to these.

Examples of the thermosetting resin include an epoxy resin, acrylic resin, oxetane resin, phenolic resin, urea resin, melamine resin, unsaturated polyester resin, silicone resin, polyurethane resins, diallyl phthalate resin, and the like; however, the thermosetting resin is not limited to these.

Examples of the photocurable resin include a (meth) acrylate polymer or copolymer formed by polymerizing or copolymerizing compounds capable of radical polymerization; however, the photocurable resin is not limited to these.

The resin may be used alone, or a combination of two or more different resins may be used.

Examples of a curing agent of the thermosetting resin include multifunctional amine, polyamide, acid anhydride, phenolic resins, and the like; however, the curing agent is not particularly limited to these. In addition, examples of a curing catalyst of the thermosetting resin include imidazole and the like; however, the curing catalyst is not particularly limited to these. The curing agent or the curing catalyst may be used alone, or a combination of two or more types may be used.

In the case where a cellulose fine fiber-containing resin composite material is produced by mixing the fine fibrous cellulose-containing sheet and a resin and by curing the resin, examples of the method of curing the resin include a method of curing by heat, a method of curing by irradiation, and the like; however, the method is not limited to these. Examples of the irradiation include infrared radiation, visible radiation, and ultraviolet radiation; however, the irradiation is not limited to these. In the case of a method of curing by heat, for example, a heat polymerization initiator may be used, and any methods can be used without any particular limitations as long as the method can cure the resin.

<Production Method of Fine Fibrous Cellulose>

Examples of the method of producing fine fibrous cellulose of yet another aspect of the present invention include a production method having a decomposing step and a fibrillating step. The order of the decomposing step and the fibrillating step are not limited; however, it is preferable to perform the fibrillating step after the decomposing step.

The method of producing the fine fibrous cellulose of the present invention can be applied to the production of the fine fiber of the present invention.

Hereinafter, each of the steps will be described below in detail.

(Decomposing Step)

The decomposing step is a step of decomposing cellulose contained in a cellulose raw material. As the decomposing step, from the perspective of ease of obtaining a target degree of polymerization, an enzyme treatment that decomposes cellulose using an enzyme or a sulfuric acid treatment that decomposes cellulose using sulfuric acid is preferable.

In particular, the enzyme treatment is more preferable from the perspective of ease of obtaining the fine fibrous cellulose. Cellulose can also be decomposed by a treatment other than the enzyme treatment and the sulfuric acid treatment. Examples of the treatment other than the enzyme treatment and the sulfuric acid treatment include a blasting treatment in which a pressurized and heated state is instantly changed to a non-pressurized state, and the like.

In the case where the enzyme treatment is performed in the decomposing step, a mechanical crushing treatment is preferably performed prior to the enzyme treatment to enhance enzyme reaction efficiency. The crushing method may be a dry method or a wet method.

A crusher used in the crushing treatment is exemplified by those described above. Of these, the crusher can be appropriately selected from the perspectives of the end use and costs.

A disintegrator that disaggregates pulp or a refiner that beats pulp may be used as the crusher.

In addition, the cellulose raw material is preferably diluted with a dispersing medium prior to the enzyme treatment so that the dispersion liquid contains from 0.2 to 20 mass % of the cellulose raw material. As the dispersing medium, either water or an organic solvent can be used; however, water is preferable.

The cellulolytic enzyme used in the enzyme treatment of the present invention is an enzyme generally termed cellulase having a cellobiohydrolase activity, an endo-glucanase activity, or a β-glucosidase activity.

The cellulolytic enzyme used in the enzyme treatment of the present invention may be a commercially available cellulase formulations although the cellulolytic enzyme may be prepared by mixing various cellulolytic enzymes with enzymes each having activity at appropriate amounts. Many of commercially available cellulase formulations simultaneously have various cellulase activities described above and a hemicellulase activity.

Commercially available cellulase formulations include cellulase formulations derived from the genus *Trichoderma*, the genus *Acremonium*, the genus *Aspergillus*, the genus *Phanerochaete*, the genus *Trametes*, the genus *Humicola*, the genus *Bacillus*, and the like. Examples of such commercially available cellulase formulations include Cell Leucine T2 (manufactured by HBI Enzymes Inc.), Meicelase (manufactured by Meiji Seika Kaisha, Limited), Novozyme 188 (manufactured by Novozymes), Multifect CX10L (manufactured by Genencor), and the like (all mentioned in trade names).

In yet another aspect of the present invention, the ratio (EG activity/CBHI activity) of the endo-glucanase activity (decomposition activity to amorphous part; hereinafter, called "EG activity") to the cellobiohydrolase activity (decomposition activity to crystal part of cellulose; hereinafter, called "CBHI activity") of the enzyme or enzyme mixture used in the enzyme treatment of the present invention is preferably 0.06 or greater, more preferably 0.1 or greater, and further preferably 1 or greater. If the ratio of the EG activity to the CBHI activity is 0.06 or greater, the aspect ratio of the cellulose fiber after the enzyme treatment will be large, and the yield of the fine fibrous cellulose will be high.

The ratio of the EG activity to the CBHI activity is preferably 20 or less, more preferably 10 or less, and further preferably 6 or less.

The range of the ratio of the EG activity to the CBHI activity is preferably from 0.06 to 20, more preferably from 0.1 to 10, and further preferably from 1 to 6.

In yet another aspect of the present invention, the ratio of β-glucosidase activity (BGL activity) to cellobiohydrolase activity (CBHI activity) contained in the enzyme used in the enzyme treatment of the present invention is preferably 0.000001 or greater and 0.30 or less, further preferably 0.000001 or greater and 0.20 or less, and particularly preferably 0.000001 or greater and 0.10 or less. If the ratio of β-glucosidase activity to cellobiohydrolase activity contained in the enzyme used in the enzyme treatment of the present invention exceeds 0.30, it is not preferable since saccharides released from cellulose will be decomposed to monosaccharide.

In the enzyme treatment of the present invention, in addition to cellulase, hemicellulase enzyme may also be used alone or in combination as the enzyme. Among the hemicellulase enzymes, xylanase which is an enzyme decomposing xylan, mannase which is an enzyme decomposing mannan, and arabanase which is an enzyme decomposing araban are preferably used. Pectinase which is an enzyme decomposing pectin can be also used as hemicellulase enzyme.

pH of the dispersion liquid in the enzyme treatment is preferably maintained in a range in which the activity of the used enzyme will be high. For example, in the case of a commercially available enzyme derived from *Trichoderma*, pH is preferably from 4 to 8.

In yet another aspect of the present invention, the temperature of the dispersion liquid in the enzyme treatment in the method of producing fine fibrous cellulose is preferably maintained in a range in which the activity of the used enzyme will be high. For example, in the case of a commercially available enzyme derived from *Trichoderma*, the temperature is preferably from 40° C. to 60° C. If the temperature is less than 40° C., the enzyme activity decreases and thus time required for the treatment will be longer. If the temperature exceeds 60° C., the enzyme may be deactivated.

Treating time of the enzyme treatment is preferably in a range of 10 minutes to 24 hours. In the case where the treating time is less than 10 minutes, it is difficult for the effect of the enzyme treatment to be exhibited. In the case where the treating time exceeds 24 hours, decomposition by the enzyme of the cellulose fiber proceeds excessively and the weighted average fiber length of the obtained fine fiber may be too short.

Since, if active enzymes remain after a prescribed time period, the cellulose decomposition proceeds excessively as described above, when the prescribed enzyme treatment ends, a terminating treatment for the enzyme reaction is preferably performed. Examples of the terminating treatment for the enzyme reaction include a method in which the dispersion liquid that has undergone the enzyme treatment is washed with water to remove the enzyme, a method in which sodium hydroxide is added to the dispersion liquid that has undergone the enzyme treatment in a manner such that the pH becomes approximately 12 to deactivate the enzyme, and a method in which the temperature of the dispersion liquid that has undergone the enzyme treatment is increased to 90° C. to deactivate the enzyme.

In the case where the cellulose is decomposed by the sulfuric acid treatment, specifically, the cellulose raw material is added to the sulfuric acid aqueous solution and heated.

As the concentration of the sulfuric acid aqueous solution, the content of sulfuric acid relative to the total mass of the sulfuric acid and water is preferably from 0.01 to 20 mass %, and more preferably from 0.1 to 10 mass %. If the sulfuric acid aqueous solution has a sulfuric acid concentration relative to the total mass of the acid and water of 0.01 mass % or greater, cellulose can be sufficiently decomposed. If the sulfuric acid aqueous solution has a sulfuric acid concentration relative to the total mass of the acid and water of 20 mass % or less, handleability will be excellent.

The heating temperature in the sulfuric acid treatment is preferably from 10 to 120° C., and more preferably from 20 to 80° C. If the heating temperature is 10° C. or greater, the decomposing reaction of cellulose can be easily controlled. To prevent water loss from the sulfuric acid aqueous solution, the vaporized water content is preferably condensed and refluxed during the heating.

(Fibrillating Step)

The fibrillating step is a step of fibrillating cellulose by micronizing the cellulose decomposed in the decomposing step.

The cellulose prior to the micronizing is preferably diluted with water in a manner that the dispersion liquid has a cellulose concentration of 0.1 to 10 mass %. The cellulose concentration is more preferably from 0.2 to 5 mass %, and further preferably from 0.3 to 3 mass %. If the cellulose concentration is 0.1 mass % or greater, fibrillation efficiency will be high. If the cellulose concentration is 10 mass % or less, viscosity increase during the fibrillating treatment can be prevented.

Examples of the micronizing method include a method of using various pulverizing apparatuses. A pulverizing apparatus same as those described above can be appropriately used as the pulverizing apparatus. Of these, high-pressure homogenizer, high speed rotation type fibrillating device, or a combined use of these is particularly preferable.

The high-pressure homogenizer is an apparatus for micronizing the dispersion liquid by applying pressure to the dispersion liquid having undergone the enzyme treatment, and instantly decompressing the pressurized dispersion liquid. The treatment using a high-pressure homogenizer may be performed once; however, by repeating the treatment twice or more times using a high-pressure homogenizer, degree of micronization can be further increased to easily obtain fine fibers having a desired fiber width. When the number of repetition is greater, the degree of micronization can be raised; however, if the number of repetitions is excessively great, the costs will be high.

Specific examples of the high-pressure homogenizer include those described above.

A high speed rotation type fibrillating device is a device in which a dispersion liquid having undergone the enzyme treatment is passed through a narrow aperture to cause a high sheer rate while being rotated at high speed. Examples of the high speed rotation type fibrillating device include a type in which the dispersion liquid to be treated is passed through an aperture between a rotating body and a fixed part. In addition, examples of the high speed rotation type fibrillating device include a type in which an inner rotating body rotating toward a fixed direction, and an outer rotating body rotating toward the opposite direction of the inner rotating body and rotating on the outer side of the inner rotating body are provided, and pulp fibers to be treated are passed through an aperture between the inner rotating body and the outer rotating body to disperse the pulp fibers.

Specific examples of the high speed rotation type fibrillating device include those described above.

After the fibrillating treatment of the present invention, the dispersion liquid having undergone the fibrillating treatment is preferably centrifuged from the perspective of easily obtaining fine fibrous cellulose having a small average fiber diameter and a small maximum fiber diameter.

In the present invention, the fine fibrous cellulose and another fiber other than the fine fibrous cellulose can be mixed for use. The fiber other than the fine fibrous cellulose is exemplified by those described above; however, the fiber is not limited to those.

In the case where the fine fibrous cellulose and another fiber other than the fine fibrous cellulose are mixed to use, the fiber other than the fine fibrous cellulose can be subjected to a chemical treatment, fibrillating treatment, or the like, as desired. In the case where the fiber other than the fine fibrous cellulose is subjected to a chemical treatment, fibrillating treatment, or the like, the fiber other than the fine fibrous cellulose may be subjected to a chemical treatment, fibrillating treatment, or the like after mixing with the fine fibrous cellulose, or the fiber other than the fine fibrous cellulose may be mixed with the fine fibrous cellulose after being subjected to a chemical treatment, fibrillating treatment, or the like. In the case where the fiber other than the fine fibrous cellulose is mixed, an added amount of the fiber other than the fine fibrous cellulose relative to the total amount of the fine fibrous cellulose and the fiber other than the fine fibrous cellulose is not particularly limited; however, the added amount is preferably 50 mass % or less, more preferably 40 mass % or less, further preferably 30 mass % or less, and particularly preferably 20 mass % or less.

In the present invention, a resin can be mixed into the fine fibrous cellulose. As the resin, a thermoplastic resin, thermosetting resin, photocurable resin, or the like can be used.

The thermoplastic resin is exemplified by those described above; however, the thermoplastic resin is not limited to those.

The thermosetting resin is exemplified by those described above; however, the thermosetting resin is not limited to those.

The photocurable resin is exemplified by those described above; however, the photocurable resin is not limited to those.

The resin may be used alone, or a combination of two or more different resins may be used.

The curing agent of the thermosetting resin is exemplified by those described above; however, the curing agent is not particularly limited to those. The curing agent and the curing catalyst may be used alone, or a combination of two or more types may be used.

In the case where a cellulose fine fiber-containing resin composite material is produced by mixing the cellulose fine fiber-containing sheet and a resin and by curing, examples of the method of curing include those described above; however, the method is not limited to those. The irradiation is exemplified by those described above; however, the irradiation is not limited to those. In the case of a method of curing by heat, for example, a heat polymerization initiator may be used, and any methods can be used without any particular limitations as long as the method can cure.

<Operation and Effect>

According to the present invention, a fine fiber having a long fiber length and a relatively large aspect ratio can be obtained. A fine fiber with a high strength can be obtained by compounding the fine fiber obtained according to the present invention in a sheet (non-woven fabric) or the like.

Since the fine fibrous cellulose of the present invention has the acid group content of 0.1 mmol/g or less, the fine fibrous cellulose is less likely to retain water, and thus enhances filterability. Therefore, when the fine fibrous cellulose is made into a sheet, the productivity will be enhanced, and the production of the sheet is facilitated. In addition, due to the acid group content being 0.1 mmol/g or less, yellowing is suppressed.

Since the fine fibrous cellulose described in Patent Document 7 has a high carboxy group content, it is thought that the filterability is low, and the production of the sheet is difficult.

In the method of producing a fine fiber in yet another aspect of the present invention, the method comprises the steps of:

(a) treating a cellulose raw material with enzymes; and (b) fibrillating the treated cellulose raw material;

the (a) treating a cellulose raw material with enzymes preferably comprising treating under a condition where a ratio of an activity of endo-glucanase to an activity of cellobiohydrolase, both at least contained in the enzymes, is from 0.06 to 20;

the (a) treating a cellulose raw material with enzymes preferably comprising treating under a condition where a ratio of an activity of β-glucosidase to the activity of the cellobiohydrolase contained in the enzymes is 0.000001 or greater and 0.30 or less; and the cellulose raw material being preferably at least one plant fiber selected from the groups of kraft pulp, deinked pulp, and sulfite pulp.

The fine fibrous cellulose of yet another aspect of the present invention preferably has an average fiber width of 1 to 1000 nm, a degree of polymerization of greater than or equal to 50 and less than 500, an acid group content of 0.0001 or greater and 0.1 mmol/g or less, and an average aspect ratio of 10 to 10000.

WORKING EXAMPLES

The present invention will be further described below using working examples, but the present invention is not limited thereto. In the examples, "part" and "%" represent "mass part" and "mass %" respectively, unless otherwise noted.

Working Example 1

A pulp dispersion liquid (A) (pulp concentration: 2%; weighted average fiber length after beaten: 1.61 mm) was obtained by beating NBKP (manufactured by Oji Paper Co., Ltd.; douglas fir product), used as chemical pulp, for 200 minutes using a Niagara beater (volume: 23 L; manufactured by Tozai Seiki K.K.). The pulp dispersion liquid (A) was dewatered to adjust the concentration to 3%, and the pH of the pulp dispersion liquid (A) was adjusted to pH 6 using 0.1% sulfuric acid, and warmed to 50° C. using a warm bath. Thereafter, 3% of an enzyme optimase CX7L (EG activity/CBHI activity=3; manufactured by Genencor) relative to the pulp content (in terms of solid content) was added, and reacted while stirring for one hour at 50° C. to obtain the pulp dispersion liquid (B).

The pulp dispersion liquid (C) in which the enzyme was deactivated was obtained by heating the pulp dispersion liquid (B) at 95° C. or greater for 20 minutes. After the enzyme treatment, the yield of the pulp was calculated by the equation below.

Yield of pulp after the enzyme treatment(%)=(mass of pulp dispersion liquid(*C*)/mass of pulp dispersion liquid(*A*))×100

(Micronizing Treatment and Yield Measurement of Fine Fiber)

The pulp dispersion liquid (C) was vacuum filtered until the electric conductivity of a 1% pulp solution became a predetermined value (10 μS/cm) or less while washing the pulp solution with ion exchanged water (No. 2 filter paper manufactured by ADVANTEC was used). The obtained sheet was placed in ion exchanged water and stirred to prepare a 0.5% dispersion liquid. Then, a fine fiber-containing dispersion liquid (D) was obtained by performing a micronizing treatment (fibrillating) for 30 minutes using a high speed rotation type fibrillating device (CLEARMIX; manufactured by M Technique Co., Ltd.; rotation: 21,500). Then, the dispersion liquid (D) was diluted to 0.2%, and centrifuged at 12,000 G for 10 minutes (H-200NR; manufactured by Kokusan Co., Ltd.), and a supernatant solution (E) was obtained. The yield of the fine fiber was calculated by the equation below.

Yield of fine fiber(%)=(concentration of supernatant solution(*E*)/0.2)×100

Furthermore, the total yield of the fine fiber was calculated by the equation below.

Total yield of fine fiber(%)=yield of pulp after the enzyme treatment×yield of fine fiber (Production of Non-Woven Fabric and Evaluation of Physical Properties)

The supernatant solution (E) was vacuum filtered using a membrane filter (T050A090C; manufactured by ADVANTEC) having a pore diameter of 0.5 μm, and a wet sheet was produced. Thereafter, two-step drying was performed using a cylinder drier (90° C., 10 minutes) and an oven (130° C., one minute) to produce a non-woven fabric of 100 g/m$^2$.

After the sheet had undergone humidity control (23° C.; humidity: 50%; 4 hours), the thickness was measured. Then, the tensile property was measured using a constant elongation tensile tester in accordance with JIS P 8113, under the conditions where the pulling speed was 5 mm/min, load was 250 N, width of the sheet test piece was 5.0±0.1 mm, and span length was 30±0.1 mm.

Working Example 2

In the micronizing treatment step, the pulp dispersion liquid (C) was vacuum filtered until the electric conductivity of a 1% pulp solution became a predetermined value (10 μS/cm) or less while washing the pulp solution with ion exchanged water (No. 2 filter paper manufactured by ADVANTEC was used). The obtained sheet was placed in water and stirred to prepare a 1.5% dispersion liquid. Then, the dispersion liquid is subjected to a 120 MPa×2 pass treatment using a high-pressure homogenizer (Panda Plus 2000; manufactured by Niro Soavi). Except for the above, an experiment was conducted in the same manner as in Working Example 1.

Working Example 3

An experiment was conducted in the same manner as in Working Example 1 except for performing a micronizing treatment (fibrillating) for 30 minutes using a high speed rotation type fibrillating device (CLEARMIX; manufactured by M Technique Co., Ltd.; rotation: 21,500) after performing a 120 MPa×1 pass treatment by a high-pressure homogenizer (Panda Plus 2000; manufactured by Niro Soavi) in the micronizing treatment step.

Working Example 4

In the micronizing treatment step, the pulp dispersion liquid (C) was vacuum filtered until the electric conductivity of a 1% pulp solution became a predetermined value (10 μS/cm) or less while washing the pulp solution with ion exchanged water (No. 2 filter paper manufactured by ADVANTEC was used). The obtained sheet was placed in water and stirred to prepare a 10% dispersion liquid. Then, the dispersion liquid is subjected to a 20 pass refining treatment using a single-disc refiner (Raffinatore; manufactured by ANDRITZ). Except for the above, an experiment was conducted in the same manner as in Working Example 1.

Working Example 5

An experiment was conducted in the same manner as in Working Example 1 except for adding 20%, relative to the pulp content (in terms of solid content), of the enzyme using Enzylon (EG activity/CBHI activity=0.12; manufactured by Rakuto Kasei Industrial Co., Ltd.).

Working Example 6

An experiment was conducted in the same manner as in Working Example 1 except for adding 2%, relative to the pulp content (in terms of solid content), of the enzyme using Ecopulp R (EG activity/CBHI activity=1.2; manufactured by AB Enzymes).

Comparative Example 1

The pulp dispersion liquid (A) of Working Example 1 was diluted to 0.5%. Then, a fine fiber-containing dispersion liquid (F) was obtained by performing a micronizing treatment (fibrillating) for 30 minutes using a high speed rotation type fibrillating device (CLEARMIX; manufactured by M Technique Co., Ltd.; rotation: 21,500). Then, the dispersion liquid (F) was diluted to 0.2% and centrifuged at 12,000 G for 10 minutes (H-200NR; manufactured by Kokusan Co., Ltd.), and a supernatant solution (G) was obtained. The yield of the fine fibers was calculated based on the same theory and method of Working Example 1.

Comparative Example 2

An experiment was conducted in the same manner as in Working Example 1 except for adding 1%, relative to the pulp content (in terms of solid content), of the enzyme using GC220 (EG activity/CBHI activity=0.05; manufactured by Genencor).

Comparative Example 3

An experiment was conducted in the same manner as in Working Example 1 except for adding 6%, relative to the pulp content (in terms of solid content), of the enzyme using Accellerase DUET (EG activity/CBHI activity=0.03; manufactured by Genencor).

TABLE 1

| | EG activity/ CBHI activity | Yield of pulp after enzyme treatment (%) | Yield of fine fiber (%) | Total yield of fine fiber (%) | Maximum stress ($N/mm^2$) |
|---|---|---|---|---|---|
| Working Example 1 | 3.2 | 97 | 55 | 53 | 141 |
| Working Example 2 | 3.2 | 97 | 48 | 47 | 108 |
| Working Example 3 | 3.2 | 97 | 78 | 76 | 125 |
| Working Example 4 | 3.2 | 97 | 40 | 39 | 110 |
| Working Example 5 | 0.12 | 95 | 46 | 44 | 94 |
| Working Example 6 | 1.5 | 97 | 45 | 44 | 131 |
| Comparative Example 1 | — | — | 11 | 11 | Due to low yield, a sheet could not be formed |
| Comparative Example 2 | 0.05 | 78 | 32 | 25 | 66 |
| Comparative Example 3 | 0.03 | 72 | 43 | 31 | 70 |

Figure 2:
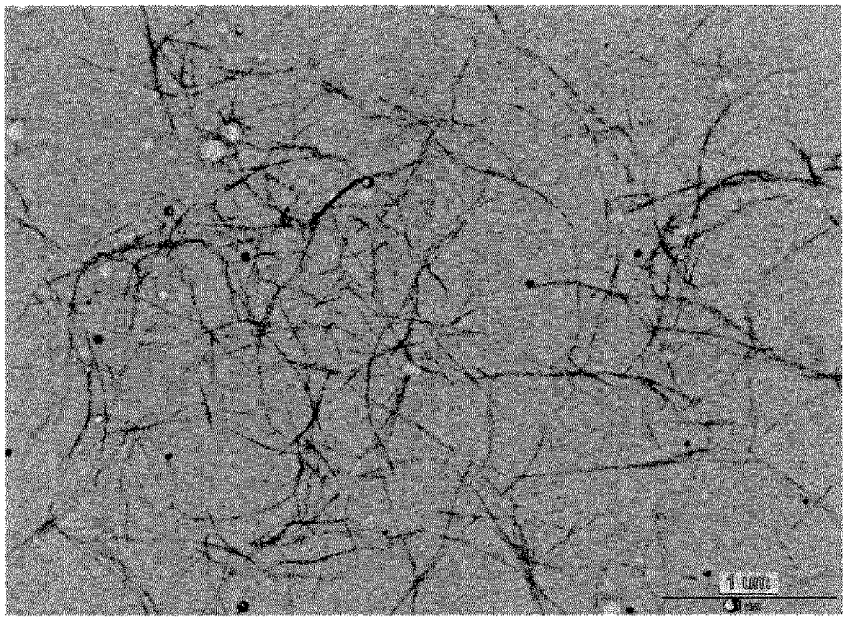
FIG. 2 is a transmission electron photomicrograph of fine fibers obtained in Working Example 5.
Figure 3:
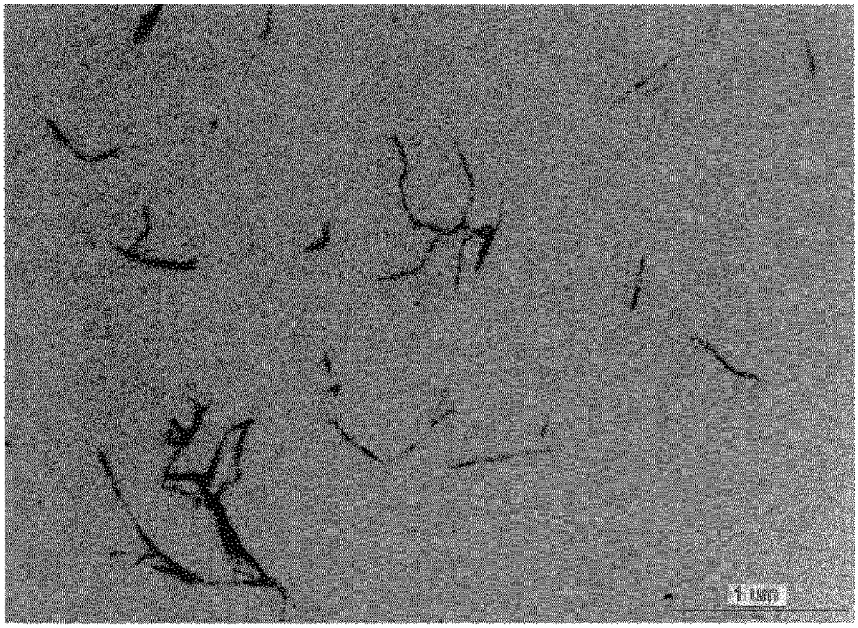
FIG. 3 is a transmission electron photomicrograph of fine fibers obtained in Comparative Example 2.

As clearly shown in Table 1, fine fibers can be obtained at a high yield according to the production method of the present invention. In addition, the non-woven fabric containing the fine fibers obtained according to the production method of the present invention has high strength. From photographs (FIGS. 1 and 2), it is understood that the fine fiber obtained by the production method of the present invention has a large aspect ratio.

Working Example 7

An experiment was conducted in the same manner as in Working Example 1 except for using an enzyme solution having a ratio EG activity/CBHT activity=2.7 and a ratio BGL activity/CBHI activity=0.06 in the enzyme treatment. The results are shown in Table 2.

Working Example 8

An experiment was conducted in the same manner as in Working Example 1 except for using an enzyme solution having a ratio EG activity/CBHI activity=2.7 and a ratio BGL activity/CBHI activity=0.11 in the enzyme treatment. The results are shown in Table 2.

Working Example 9

An experiment was conducted in the same manner as in Working Example 1 except for using an enzyme solution having a ratio EG activity/CBHI activity=2.7 and a ratio BGL activity/CBHI activity=0.22 in the enzyme treatment. The results are shown in Table 2.

Working Example 10

An experiment was conducted in the same manner as in Working Example 1 except for using an enzyme solution having a ratio EG activity/CBHI activity=2.7 and a ratio BGL activity/CBHI activity=0.30 in the enzyme treatment. The results are shown in Table 2.

Working Example 11

An experiment was conducted in the same manner as in Working Example 1 except for using an enzyme solution having a ratio EG activity/CBHI activity=2.7 and a ratio BGL activity/CBHI activity=0.45 in the enzyme treatment. The results are shown in Table 2.

Working Example 12

An experiment was conducted in the same manner as in Working Example 1 except for using an enzyme solution having a ratio EG activity/CBHI activity=2.7 and a ratio BGL activity/CBHI activity=0.74 in the enzyme treatment. The results are shown in Table 2.

TABLE 2

| | EG activity/ CBHI activity | BGL activity/ CBHI activity | Yield of pulp after enzyme treatment (%) | Yield of fine fiber (%) | Total yield of fine fiber (%) | Maximum stress ($N/mm^2$) |
|---|---|---|---|---|---|---|
| Working Example 7 | 2.7 | 0.06 | 97 | 54 | 53 | 138 |
| Working Example 8 | 2.7 | 0.11 | 97 | 52 | 51 | 132 |
| Working Example 9 | 2.7 | 0.22 | 97 | 51 | 50 | 127 |
| Working Example 10 | 2.7 | 0.30 | 97 | 49 | 48 | 115 |
| Working Example 11 | 2.7 | 0.45 | 82 | 43 | 41 | 76 |
| Working Example 12 | 2.7 | 0.74 | 78 | 40 | 37 | 69 |

When an enzyme treatment was performed under a condition where the ratio EG activity/CBHI activity=2.7 and the ratio BGL activity/CBHI activity=0.30 or less (Working Examples 7 to 10), the yield of the fine fiber was high. In addition, the non-woven fabric produced from the cellulose fine fiber that was subjected to the enzyme treatment under the condition described above (Working Examples 7 to 10) had high strength.

Working Example 13

A pulp dispersion liquid (K) (pulp concentration: 2%; weighted average fiber length after beaten: 1.61 mm) was obtained by beating NBKP (manufactured by Oji Paper Co., Ltd.; moisture content: 50%; Canadian standard freeness (CSF) measured in accordance with JIS P 8121: 600 mL), that is chemical pulp, for 200 minutes using a Niagara beater (volume: 23 L; manufactured by Tozai Seiki K.K.).

The pulp dispersion liquid (K) was dewatered to adjust the concentration to 3%, and the pH of the pulp dispersion liquid (K) was adjusted to pH 6 using 0.1% sulfuric acid, and warmed to 50° C. using a warm bath. Thereafter, 3% of an enzyme optimase CX7L (EG activity/CBHI activity=3; manufactured by Genencor) relative to the pulp content (in terms of solid content) was added, and reacted while stirring for one hour at 50° C. to perform the enzyme treatment. Then, the enzyme treated dispersion liquid (L) was obtained by heating the pulp dispersion liquid (K) at 95° C. or greater for 20 minutes and deactivating the enzyme.

The enzyme treated dispersion liquid (L) was vacuum filtered until the electric conductivity of a 1% pulp solution became a predetermined value (10 μS/cm) or less while washing the enzyme treated dispersion liquid with ion exchanged water (No. 2 filter paper manufactured by ADVANTEC was used). Residue on the filter paper was placed in ion exchanged water and stirred, and 0.5% dispersion liquid was prepared. A fibrillated pulp dispersion liquid (M) was obtained by treating the dispersion liquid with a micronizing treatment (fibrillating) for 30 minutes using a high speed rotation type fibrillating device (CLEARMIX; manufactured by M Technique Co., Ltd.; rotation: 21,500).

After the concentration of the fibrillated pulp dispersion liquid (M) was adjusted in a manner such that the cellulose concentration thereof was 0.1%, the fibrillated pulp dispersion liquid (M) was vacuum filtered using a membrane filter (T050A090C; manufactured by ADVANTEC) having a pore diameter of 0.5 μm, and a wet sheet was produced. The wet sheet was dried by a two-step drying using a cylinder drier (90° C., 10 minutes) and an oven (130° C., one minute) to produce a non-woven fabric-like sheet of 100 $g/m^2$.

Working Example 14

The fibrillated pulp dispersion liquid (M) of Working Example 13 was diluted in a manner such that the cellulose concentration thereof was 0.2%. Then, the fibrillated pulp dispersion liquid (M) was centrifuged at 12,000 G for 10 minutes (H-200NR Centrifuge; manufactured by Kokusan Co., Ltd.), and a supernatant solution (N) was obtained. Then, a sheet was produced in the same manner as in Working Example 13 except for using the supernatant solution (N) in place of the fibrillated pulp dispersion liquid (M).

Working Example 15

A fibrillated pulp dispersion liquid (O) was obtained by performing a 120 MPa×1 pass treatment by a high-pressure homogenizer (Panda Plus 2000; manufactured by Niro Soavi) and using a high speed rotation type fibrillating device (CLEARMIX; manufactured by M Technique Co., Ltd.) in the micronizing treatment of Working Example 13 under the same condition as in Working Example 13. Then, a sheet was obtained in the same manner as in Working Example 13 except for using the fibrillated pulp dispersion (O) in place of the fibrillated pulp dispersion liquid (M).

Working Example 16

The fibrillated pulp dispersion liquid (O) of Working Example 15 was adjusted in a manner such that the cellulose concentration thereof was 0.2%. Then, the fibrillated pulp dispersion liquid (O) was centrifuged at 12,000 G for 10 minutes (H-200NR Centrifuge; manufactured by Kokusan Co., Ltd.), and a supernatant solution (P) was obtained. Then, a sheet was produced in the same manner as in Working Example 13 except for using the supernatant solution (P) in place of the fibrillated pulp dispersion liquid (M).

Working Example 17

An aqueous solution of phosphoric acid-based compound (hereinafter, called the "phosphoric acid compound reagent") was obtained by dissolving 1.69 g of sodium dihydrogenphosphate dihydrate and 1.21 g of disodium hydrogenphosphate in 3.39 g of water. The pH of the phosphoric acid compound reagent was 6.0 at 25° C.

After NBKP (manufactured by Oji Paper Co., Ltd.; moisture content: 50%; Canadian standard freeness (CSF) measured in accordance with MS P 8121: 600 mL) in a 5% sulfuric acid aqueous solution at 50° C. was heated for 15 minutes while refluxing, a sulfuric acid treatment pulp was obtained by sufficiently washing the NBKP with ion exchanged water. The obtained sulfuric acid treatment pulp was diluted with ion exchanged water in a manner such that the moisture content was 80% to obtain a pulp slurry. 6.29 g of the phosphoric acid compound reagent (20 mass parts, in terms of phosphorous element content, relative to 100 mass parts of dried pulp) was added to 15 g of this pulp slurry, and then dried until the mass became constant using a fan drier at 105° C. (DKM400; Yamato Scientific Co., Ltd.) while kneading every 15 minutes. Thereafter, the mixture was heat treated using a fan drier at 150° C. for one hour, and a phosphoric acid group was introduced into cellulose.

Then, 300 mL of ion exchanged water was added to the cellulose in which the phosphoric acid group was introduced. After the mixture was stirred and washed, the mixture was dewatered. The dewatered pulp was diluted with 300 mL of ion exchanged water. While stirring, 5 mL of a 1N sodium hydroxide aqueous solution was added gradually to the mixture, and a pulp slurry having a pH of 12 to 13 was obtained. Thereafter, this pulp slurry was dewatered and washed by adding 300 mL of ion exchanged water. This dewatering/washing was further repeated twice.

Ion exchanged water was added to the obtained pulp after the dewatering/washing, and then the mixture was stirred to form a 0.5 mass % slurry. A fibrillated pulp dispersion liquid was obtained by subjecting this pulp slurry to a fibrillating treatment for 30 minutes using a fibrillating treatment device (CLEARMIX-2.2S; manufactured by M Technique Co., Ltd.) under a condition at 21,500 rotations/min.

300 mL aliquot of the obtained fibrillated pulp dispersion liquid was placed in a pressure sensitive container made from SUS304, and heated at 120° C. for two hours using an autoclave to remove a phosphoric acid group via hydrolysis treatment. Thereafter, a 1/10, in terms of the volume relative to the dispersion liquid, of ion exchange resin was added to the hydrolysis-treated dispersion liquid, and the mixture was shaken for one hour. Then, the mixture was poured onto a mesh having apertures of 90 μm to perform a treatment to remove the ion exchange resin from the dispersion liquid. Thereby, a dephosphorized fibrillated pulp dispersion liquid was obtained. A series of steps of the ion exchange resin addition, the shaking treatment, and the ion exchange resin removal treatment was repeated three times. In the first time and the third time, a strong acid ion exchange resin having undergone a conditioning (e.g. Amberjet 1024; Organo Corporation) was used. In the second time, a strong base ion exchange resin having undergone a conditioning (e.g. Amberjet 4400; Organo Corporation) was used.

The obtained dephosphorized fibrillated pulp dispersion liquid was diluted in a manner such that the cellulose concentration thereof was 0.2%. Then, the dephosphorized fibrillated pulp dispersion liquid was centrifuged at 12,000 G for 10 minutes (H-200NR Centrifuge; manufactured by Kokusan Co., Ltd.), and a supernatant solution (Q) was obtained.

Then, a sheet was produced in the same manner as in Working Example 13 except for using the supernatant solution (Q) in place of the fibrillated pulp dispersion liquid (M).

Comparative Example 4

A 0.5% dispersion liquid of NBKP (manufactured by Oji Paper Co., Ltd.; moisture content: 50%; Canadian standard freeness (CSF) measured in accordance with JIS P 8121: 600 mL) was prepared. The dispersion liquid was subjected to fibrillating treatment for 15 minutes using a CLEAMIX-2.2S manufactured by M Technique Co., Ltd., and the average fiber diameter was measured. Until the average fiber diameter became 190 nm, the fibrillating treatment was repeated, and a fibrillated pulp dispersion liquid (R) was obtained.

Then, a sheet was produced in the same manner as in Working Example 13 except for using the fibrillated pulp dispersion liquid (R) in place of the fibrillated pulp dispersion liquid (M).

Comparative Example 5

A sheet was produced in the same manner as in Working Example 17 except for not treating the NBKP with a sulfuric acid aqueous solution.

Comparative Example 6

40 g (in terms of absolute dry cellulose) of NBKP (manufactured by Oji Paper Co., Ltd.; moisture content: 50%; Canadian standard freeness (CSF) measured in accordance with JIS P 8121: 600 mL) was added to 500 mL of 0.1 mol/L sulfuric acid, and stirred to obtain a suspension. The suspension was vacuum filtered using a filter paper to obtain pulp wetted with dilute sulfuric acid. The obtained pulp was placed in a separable flask and subjected to an ozone treatment performed by introducing ozone-containing oxygen gas (gas flow rate: 2 L/min; ozone concentration: 30 $g/m^3$; ozone generation rate: 3.6 g/hr) generated by an ozone gas generator (model: ED-OG-A10; manufactured by Eco Design Inc.) into the separable flask for 0.5 hours. The temperature during the ozone treatment was at room temperature (about 25° C.).

Thereafter, ozone treated pulp was taken out from the separable flask, and repeatedly suspended in ion exchanged water and washed. The washing was completed when the pH of the rinse water became pH 4.5 or greater. Then, the washed pulp was vacuum filtered using a filter paper to obtain an ozone treated cellulose fiber (solid content concentration: 20%).

Into 50 g of the obtained ozone treated cellulose fiber (10 g as absolute dry cellulose fiber), 150 g of 2% sodium chlorite aqueous solution in which pH was adjusted to pH 4 was added. After stirring the mixture, an additional oxidation treatment was performed by leaving at room temperature for 48 hours. The temperature during the additional oxidation treatment was at room temperature (about 25° C.). The pulp having undergone the additional oxidation treatment was repeatedly suspended in ion exchanged water and washed. The washing was completed when the pH of the rinse water became pH 8 or lower. Thereafter, the washed pulp was vacuum filtered using a filter paper, ion exchanged water was added to the obtained pulp, and then the mixture was stirred to obtain a 0.5% slurry. A fibrillated pulp dispersion liquid was obtained by subjecting this pulp slurry to a fibrillating treatment for 30 minutes using a fibrillating treatment device (CLEARMIX-2.2S; manufactured by M Technique Co., Ltd.) under a condition at 21,500 rotations/min.

The obtained fibrillated pulp dispersion liquid was diluted in a manner such that the cellulose concentration thereof was 0.2%. Then, the fibrillated pulp dispersion liquid was centrifuged at 12,000 G for 10 minutes (H-200NR Centrifuge; manufactured by Kokusan Co., Ltd.), and a supernatant solution (S) was obtained.

Then, it was attempted to produce a sheet in the same manner as in Working Example 13 except for using the supernatant solution (S) in place of the fibrillated pulp dispersion liquid (M).

Comparative Example 7

A sheet was produced in the same manner as in Comparative Example 6 except for changing the ozone concentration to 180 g/m$^3$.

Comparative Example 8

A pulp slurry was obtained by diluting the NBKP (manufactured by Oji Paper Co., Ltd.; moisture content: 50%; Canadian standard freeness (CSF) measured in accordance with JIS P 8121: 600 mL) with ion exchanged water in the manner such that the water content was 80%. 6.29 g of the same phosphoric acid compound reagent as the reagent used in Working Example 17 (20 mass parts, in terms of phosphorous element content, relative to 100 mass parts of dried pulp) was added to 15 g of this pulp slurry, and then dried until the mass became constant using a fan drier at 105° C. (DKM400; Yamato Scientific Co., Ltd.) while kneading every 15 minutes. Thereafter, the mixture was heat treated using a fan drier at 150° C. for one hour, and a phosphoric acid group was introduced into cellulose.

Then, 300 mL of ion exchanged water was added to the cellulose in which the phosphoric acid group was introduced. After the mixture was stirred and washed, the mixture was dewatered. The dewatered pulp was diluted with 300 mL of ion exchanged water. While stirring, 5 mL of a 1N sodium hydroxide aqueous solution was added gradually to the mixture, and a pulp slurry having a pH of 12 to 13 was obtained. Thereafter, this pulp slurry was dewatered and washed by adding 300 mL of ion exchanged water. This dewatering/washing was further repeated twice.

Ion exchanged water was added to the obtained pulp after the dewatering/washing, and then the mixture was stirred to form a 0.5 mass % slurry. A fibrillated pulp dispersion liquid was obtained by subjecting this pulp slurry to a fibrillating treatment for 30 minutes using a fibrillating treatment device (CLEARMIX-2.2S; manufactured by M Technique Co., Ltd.) under a condition at 21,500 rotations/min.

The obtained fibrillated pulp dispersion liquid was diluted in a manner such that the cellulose concentration thereof was 0.2%. Then, the fibrillated pulp dispersion liquid was centrifuged at 12,000 G for 10 minutes (H-200NR Centrifuge; manufactured by Kokusan Co., Ltd.), and a supernatant solution (T) was obtained.

Then, it was attempted to produce a sheet in the same manner as in Working Example 13 except for using the supernatant solution (T) in place of the fibrillated pulp dispersion liquid (M). However, the filtration was difficult and a sheet could not be produced.

(Evaluation)

For the obtained fine fibrous celluloses of Working Examples 13 to 17 and Comparative Examples 4 to 8, the average fiber width, degree of polymerization, aspect ratio, and acid group content were measured. The results of the measurements are shown in Table 3.

In addition, for the obtained sheet of Working Examples 13 to 17 and Comparative Examples 4 to 8, the filtration time during the production, tensile strength of the sheet, degree of yellowness of the sheet, fluidity and viscosity of the dispersion liquid were measured. The results of the measurements are shown in Table 3.

[Average Fiber Width]

The average fiber width was measured by a method described in the "Measurement of the average fiber width by observation of the fine fibrous cellulose using an electron microscope" above.

[Degree of Polymerization]

The degree of polymerization was measured by a method described in the "Measurement of degree of polymerization" above.

[Aspect Ratio]

The fiber length and the fiber width were measured by an image analysis of TEM photograph, and then aspect ratio was determined based on "fiber length/fiber width."

[Acid Group Content]

The acid group content was measured by a method described in the "Measurement of acid group content" above.

[Filtration Time]

When sheets of Working Examples 13 to 21 and Comparative Examples 4 to 8 were produced, 400 mL of cellulose fiber-containing slurry having a concentration of 0.1% was collected and vacuum filtered. KG-90 manufactured by ADVANTEC was used as a filtration apparatus, and a membrane filter formed from PTFE (T050A090C; manufactured by ADVANTEC) having a pore size of 0.5 μm and an area of 48 cm$^2$ was placed on a glass filter. The vacuum filtration was performed in a manner such that the pressure was −0.09 MPa (absolute degree of vacuum 10 kPa), and the filtration time was defined as a time required for the mass of the solvent-containing cellulose fiber on the filter to become 4 g. Shorter filtration time indicates better filterability.

[Tensile Strength of the Sheet]

After the obtained sheet had undergone humidity control (23° C.; humidity: 50%; 4 hours), the thickness was measured. Then, the tensile strength was measured using a constant elongation tensile tester in accordance with JIS P 8113. At this time, the pulling speed was 5 mm/min, load was 250 N, width of the sheet test piece was 5.0±0.1 mm, and span length was 30±0.1 mm.

[Degree of Yellowness of the Sheet]

155 g aliquot of the fibrillated pulp dispersion liquid in which the concentration was adjusted to 0.1% or the supernatant thereof of Working Examples 13 to 21 and Comparative Examples 4 to 8 was subjected to vacuum filtration. KG-90 manufactured by ADVANTEC was used as a filtration apparatus, and a membrane filter formed from PTFE (T050A090C; manufactured by ADVANTEC) having a pore size of 0.5 μm and an area of 48 cm$^2$ was placed on a glass filter. Cellulose fiber deposit was obtained on the membrane filter formed from PTFE. 3.76 mL of ethylene glycol mono-t-butylether was poured onto the cellulose fiber deposit, and the deposit was obtained by performing another vacuum filtration. After this deposit was dried for 5 minutes using a cylinder drier heated at 120° C., the deposit was further dried for 2 minutes using a fan drier at 130° C. to obtain a porous sheet. After heating the obtained sheet for 4 hours at 200° C.

under vacuum, E313 yellowness index was measured in accordance with ASTM Standard using a Handy Spectrophotometer (SpectroEye) manufactured by GretagMacbeth GmbH.

[Fluidity and Viscosity of the Dispersion Liquid]

The fibrillated pulp dispersion liquid or the supernatant solution was condensed by vacuum filtration on a membrane filter (T050A090C; ADVANTEC) having a pore size of 0.5 μm. The filtration was completed when the concentration of the dispersion liquid became 1%. The obtained dispersion liquid was treated using a homomixer (T-18 ULTRA-TURRAX; manufactured by IKA) for 2 minutes under a condition of 11,000 rotations/min. After the dispersion liquid was left standing for 24 hours, fluidity was visually evaluated based on the criteria below.

A: The fluidity was excellent.

B: The dispersion liquid tended to be gel-like, and the fluidity was somewhat poor.

C: There was a strong tendency for the dispersion liquid to be gel-like, and the fluidity was significantly poor.

In addition, viscosity was measured using the dispersion liquid having a concentration of 0.1%. The viscosity was measured in accordance with JIS K 7117-1 using a B type viscometer.

TABLE 3

| | Average fiber width (nm) | Degree of polymerization | Average aspect ratio | Acid group content (mmol/g) | Filtration time (min) | Tensile strength of the sheet (MPa) | Degree of yellowness of the sheet | Fluidity of the dispersion liquid | Viscosity of the dispersion liquid (mPa · s) |
|---|---|---|---|---|---|---|---|---|---|
| Working Example 13 | 140 | 245 | 80 | 0.05 | 110 | 100 | 1.8 | A | 5 |
| Working Example 14 | 16 | 180 | 105 | 0.05 | 280 | 145 | 2.2 | A | 4 |
| Working Example 15 | 80 | 195 | 85 | 0.06 | 140 | 105 | 2.8 | A | 5 |
| Working Example 16 | 12 | 200 | 145 | 0.06 | 260 | 125 | 4.3 | A | 4 |
| Working Example 17 | 6 | 420 | 80 | 0.01 | 240 | 110 | 3.5 | A | 6 |
| Comparative Example 4 | 190 | 1100 | — | 0.05 | 150 | 65 | 1.0 | B | 7 |
| Comparative Example 5 | 6 | 780 | 270 | 0.01 | 300 | 115 | 4.0 | C | 40 |
| Comparative Example 6 | 30 | 420 | 40 | 0.13 | 650 | 85 | 35 | A | 7 |
| Comparative Example 7 | 10 | 180 | 50 | 0.25 | 700 | 80 | 60 | A | 6 |
| Comparative Example 8 | 4 | 890 | — | 0.71 | 24 hours or greater | Sheet could not be produced | — | C | 10 |

The fine fibrous celluloses of Working Examples 13 to 21 having an average fiber width of 150 nm or less, degree of polymerization of greater than or equal to 50 and less than 500, and acid group content of 0.1 mmol/g or less resulted in a short filtration time and were easily formed into sheets. The obtained sheets had high tensile strength and low degree of yellowness. In addition, the fluidity of the dispersion liquids was high and the viscosity thereof was low.

In contrast, the fine fibrous cellulose of Comparative Example 4 having an average fiber width of 190 nm and degree of polymerization of 1100 resulted in a low tensile strength when formed into a sheet. In addition, the fluidity of the dispersion liquid was low.

The fine fibrous cellulose of Comparative Example 5 having a degree of polymerization of 780 resulted in a low fluidity and high viscosity of the dispersion liquid.

The fine fibrous cellulose of Comparative Example 6 having an acid group content of 0.13 mmol/g, and the fine fibrous cellulose of Comparative Example 7 having an acid group content of 0.25 mmol/g resulted in long filtration times and low tensile strengths when formed into sheets.

The fine fibrous cellulose of Comparative Example 7 having a degree of polymerization of 890 and an acid group content of 0.71 mmol/g could not be formed into a sheet due to the high water retention. In addition, the fluidity of the dispersion liquid was low and the viscosity thereof was somewhat high.

Working Example 18

An experiment was conducted in the same manner as in Working Example 13 except for using an enzyme solution having a ratio EG activity/CBHI activity=2.7 and a ratio BGL activity/CBHI activity=0.06 in the enzyme treatment. The results are shown in Table 4.

Working Example 19

An experiment was conducted in the same manner as in Working Example 13 except for using an enzyme solution having a ratio EG activity/CBHI activity=2.7 and a ratio BGL activity/CBHI activity=0.11 in the enzyme treatment. The results are shown in Table 4.

Working Example 20

An experiment was conducted in the same manner as in Working Example 13 except for using an enzyme solution having a ratio EG activity/CBHI activity=2.7 and a ratio BGL activity/CBHI activity=0.22 in the enzyme treatment. The results are shown in Table 4.

Working Example 21

An experiment was conducted in the same manner as in Working Example 13 except for using an enzyme solution having a ratio EG activity/CBHI activity=2.7 and a ratio BGL activity/CBHI activity=0.30 in the enzyme treatment. The results are shown in Table 4.

TABLE 4

| | Average fiber width (nm) | Degree of polymerization | Average aspect ratio | Acid group content (mmol/g) | Filtration time (min) | Tensile strength of the sheet (MPa) | Degree of yellowness of the sheet | Fluidity of the dispersion liquid | Viscosity of the dispersion liquid (mPa · s) |
|---|---|---|---|---|---|---|---|---|---|
| Working Example 18 | 130 | 370 | 154 | 0.05 | 120 | 135 | 1.8 | A | 5 |
| Working Example 19 | 120 | 355 | 135 | 0.05 | 110 | 120 | 2.0 | A | 4 |
| Working Example 20 | 115 | 350 | 140 | 0.06 | 105 | 115 | 2.0 | A | 4 |
| Working Example 21 | 115 | 355 | 145 | 0.06 | 105 | 105 | 2.0 | A | 4 |

In the cases where a sheet was produced from cellulose fine fiber that was subjected to an enzyme treatment under a condition where the ratio EG activity/CBHT activity=2.7 and the ratio BGL activity/CBHI activity=0.30 or less (Working Examples 18 to 21), the tensile strength of the sheet was high and the degree of yellowness was low. In addition, the fluidity of the dispersion liquid was high and the viscosity thereof was low.

INDUSTRIAL APPLICABILITY

A fine fiber and fine fibrous cellulose obtained by the production method of the present invention can be used in non-woven fabrics, food products, medical treatments, various reinforcing materials, and the like. In addition, a non-woven fabric of the present invention can be used in filters, forming a composite with a matrix material, and the like.

The invention claimed is:

1. A method of producing a fine fiber, comprising:

treating a cellulose raw material with an enzyme or an enzyme mixture; and fibrillating the treated cellulose raw material, wherein the cellulose raw material is a pulp for paper-making, a cotton pulp, a non-wood pulp, or cellulose isolated from sea squirts or seaweeds, wherein said treating the cellulose raw material with the enzyme or the enzyme mixture comprises:

(a) treating the cellulose raw material with the enzyme, wherein the enzyme has both endo-glucanase activity and cellobiohydrolase activity, and wherein a ratio of the endo-glucanase activity relative to the cellobiohydrolase activity is 0.12 or greater; or (b) treating the cellulose raw material with the enzyme mixture, wherein the enzyme mixture at least contains endo-glucanase and cellobiohydrolase, and wherein a ratio of the activity of the endo-glucanase relative to the activity of the cellobiohydrolase is 0.12 or greater.

2. The method of producing a fine fiber according to claim 1, wherein said treating the cellulose raw material with the enzyme or the enzyme mixture comprises:

(c) treating the cellulose raw material with the enzyme, wherein the enzyme has both β-glucosidase activity and cellobiohydrolase activity, and wherein a ratio of the β-glucosidase activity relative to the cellobiohydrolase activity is 0.30 or less; or (d) treating the cellulose raw material with the enzyme mixture, wherein the enzyme mixture at least contains β-glucosidase and cellobiohydrolase, and wherein a ratio of the activity of β-glucosidase relative to the activity of the cellobiohydrolase is 0.30 or less.

3. The method of producing a fine fiber according to claim 1, wherein said ratio of the endo-glucanase activity relative to the cellobiohydrolase activity is between 0.12 and 3.2 in said (a), or said ratio of the activity of endo-glucanase relative to the activity of the cellobiohydrolase is between 0.12 and 3.2 in said (b).

* * * * *